US012710038B2

(12) United States Patent
Kachkovskiy et al.

(10) Patent No.: US 12,710,038 B2
(45) Date of Patent: Aug. 18, 2026

(54) FLUID END WITH TRANSITION SURFACE GEOMETRY

(71) Applicant: GD Energy Products, LLC, Tulsa, OK (US)

(72) Inventors: Vadim Kachkovskiy, Spring Mills, PA (US); James Black, Sperry, OK (US)

(73) Assignee: GD ENERGY PRODUCTS, LLC., Tulsa, OK (US)

( * ) Notice: Subject to any disclaimer, the term of this patent is extended or adjusted under 35 U.S.C. 154(b) by 0 days.

(21) Appl. No.: 19/033,866

(22) Filed: Jan. 22, 2025

(65) Prior Publication Data

US 2025/0243859 A1 Jul. 31, 2025

Related U.S. Application Data

(60) Provisional application No. 63/625,568, filed on Jan. 26, 2024.

(51) Int. Cl.

| | |
|---|---|
| ***F04B 53/00*** | (2006.01) |
| ***F04B 53/10*** | (2006.01) |
| ***F04B 53/16*** | (2006.01) |

(52) U.S. Cl.

CPC ..... *F04B 53/16* (2013.01); *F04B 53/007* (2013.01); *F04B 53/1032* (2013.01)

(58) Field of Classification Search

CPC ..... F04B 53/16; F04B 53/007; F04B 53/1032

See application file for complete search history.

(56) References Cited

U.S. PATENT DOCUMENTS

| | | | |
|---|---|---|---|
| 2,325,672 | A | 8/1943 | Groff |
| 2,816,515 | A | 12/1957 | Alexander et al. |
| 4,520,837 | A | 6/1985 | Cole et al. |
| 4,520,842 | A | 6/1985 | Elliott |
| 5,701,872 | A | 12/1997 | Kaku et al. |

(Continued)

FOREIGN PATENT DOCUMENTS

| | | | |
|---|---|---|---|
| CA | 2949708 | A1 | 11/2015 |
| CN | 106286181 | A | 1/2017 |

OTHER PUBLICATIONS

Merriam-Webster Dictionary, Definition of Step, Dec. 26, 2005, 4 pages, obtained from https://www.merriam-webster.com/dictionary/step.

(Continued)

*Primary Examiner* — Thomas E Lazo

(74) *Attorney, Agent, or Firm* — Edell, Shapiro & Finnan, LLC

(57) ABSTRACT

A fluid end of a reciprocating pump includes multiple bores formed therein, and adjacent bores intersect each other. The intersection of two adjacent bores forms an intersection corner, which is where a concentration of high stress occurs during operation of the reciprocating pump. At least one of the bores includes a first tapered portion and a second tapered portion. The first tapered portion increases a cross-sectional area of the bore toward the crossbore to reduce the concentration of stress on the intersection corners. The second tapered portion decreases a cross-sectional area of the bore to provide a ledge having an extended arc length and forming a groove. The extended arc length of the ledge increases an available surface area to secure a valve retainer within the groove.

20 Claims, 15 Drawing Sheets

(56) References Cited

U.S. PATENT DOCUMENTS

| | | | | |
|---|---|---|---|---|
| 6,241,492 | B1 | 6/2001 | Pacht | |
| 6,382,940 | B1 | 5/2002 | Blume | |
| 6,544,012 | B1 | 4/2003 | Blume | |
| 6,623,259 | B1 | 9/2003 | Blume | |
| 6,910,871 | B1 * | 6/2005 | Blume | F04B 53/007 417/454 |
| 7,186,097 | B1 | 3/2007 | Blume | |
| 7,335,002 | B2 | 2/2008 | Vicars | |
| 7,341,435 | B2 | 3/2008 | Vicars | |
| 7,364,412 | B2 | 4/2008 | Kugelev et al. | |
| 7,506,574 | B2 | 3/2009 | Jensen et al. | |
| 7,513,759 | B1 | 4/2009 | Blume | |
| 7,681,589 | B2 | 3/2010 | Schwegman | |
| 7,954,510 | B2 | 6/2011 | Schwegman | |
| 7,984,671 | B2 | 7/2011 | Jensen et al. | |
| 8,074,679 | B2 | 12/2011 | Jensen et al. | |
| 8,147,227 | B1 | 4/2012 | Blume | |
| 8,348,644 | B2 | 1/2013 | Tsutsumidani | |
| 8,784,081 | B1 * | 7/2014 | Blume | F04B 53/22 417/559 |
| 8,894,392 | B1 | 11/2014 | Blume | |
| 8,915,722 | B1 | 12/2014 | Blume | |
| 9,188,121 | B1 * | 11/2015 | Dille | F04B 53/16 |
| 9,297,375 | B1 | 3/2016 | Dille | |
| 9,310,011 | B2 * | 4/2016 | Pendleton | F04B 53/16 |
| 9,383,015 | B2 * | 7/2016 | Cary | F16J 10/02 |
| 9,416,887 | B2 | 8/2016 | Blume | |
| 9,435,454 | B2 | 9/2016 | Blume | |
| 9,732,746 | B2 | 8/2017 | Chandrasekaran et al. | |
| 10,273,954 | B2 | 4/2019 | Brown et al. | |
| 10,302,078 | B2 | 5/2019 | Hiller | |
| 10,337,508 | B2 | 7/2019 | Cary et al. | |
| 10,731,643 | B2 * | 8/2020 | DeLeon, II | F04B 53/1032 |
| 10,907,632 | B2 | 2/2021 | Morreale et al. | |
| 10,941,866 | B2 * | 3/2021 | Nowell | F16K 21/04 |
| 11,181,108 | B2 * | 11/2021 | Brooks | F04B 53/1025 |
| 11,225,861 | B1 * | 1/2022 | Dille | F04B 19/22 |
| 11,346,340 | B2 * | 5/2022 | DeLeon, II | F04B 53/1087 |
| 2005/0200081 | A1 | 9/2005 | Stanton et al. | |
| 2007/0295411 | A1 * | 12/2007 | Schwegman | F16K 15/063 137/542 |
| 2008/0152523 | A1 | 6/2008 | Jensen et al. | |
| 2008/0282879 | A1 | 11/2008 | Arnold et al. | |
| 2010/0288958 | A1 | 11/2010 | Vicars | |
| 2011/0206546 | A1 | 8/2011 | Vicars | |
| 2012/0255634 | A1 * | 10/2012 | Pendleton | F16L 41/03 137/561 A |
| 2012/0288387 | A1 | 11/2012 | Freed et al. | |
| 2014/0345452 | A1 | 11/2014 | Cary | |
| 2017/0082103 | A1 * | 3/2017 | Morreale | F04B 53/162 |
| 2017/0146011 | A1 | 5/2017 | Hiller | |
| 2017/0159655 | A1 | 6/2017 | Morreale | |
| 2017/0363082 | A1 | 12/2017 | Cary et al. | |
| 2019/0072089 | A1 | 3/2019 | Buckley | |
| 2019/0101114 | A1 * | 4/2019 | DeLeon, II | F04B 53/1087 |
| 2019/0154033 | A1 * | 5/2019 | Brooks | F16K 15/026 |
| 2019/0242373 | A1 | 8/2019 | Wernig | |
| 2019/0247957 | A1 | 8/2019 | Stribling et al. | |
| 2019/0309858 | A1 * | 10/2019 | Nowell | F04B 1/0452 |
| 2020/0355182 | A1 | 11/2020 | Deleon, II | |
| 2023/0167817 | A1 | 6/2023 | Hurst et al. | |
| 2023/0407852 | A1 | 12/2023 | Vey et al. | |
| 2024/0133373 | A1 | 4/2024 | Kay | |
| 2024/0401587 | A1 * | 12/2024 | Kay | F04B 53/007 |

OTHER PUBLICATIONS

Merriam-Webster Dictionary, Definition of Hemisphere, Jan. 15, 2007, 2 pages, obtained from https://www.merriam-webster.com/dictionary/hemisphere.

Mathwords.com, Foci of an Ellipse, Aug. 14, 2024, 1 page, obtained from https://www.mathwords.com/f/foci_ellipse.htm.

Merriam-Webster Dictionary, Definition of Smooth, Apr. 22, 2009, 3 pages, obtained from https://www.merriam-webster.com/dictionary/smooth.

Office Action from the United States Patent and Trademark Office for U.S. Appl. No. 13/646,170 dated Jun. 30, 2015, 11 pages.

Merriam-Webster, Definition of Radius, Apr. 2009, https://www.merriam-webster.com/dictionary/radius, 9 pages.

Cambridge Dictionary Definition of Similar, Aug. 2015, https://dictionary.cambridge.org/us/dictionary/english/similar, 5 pages.

Wikipedia, Steinmetz Solid, Apr. 2009, https://en.wikipedia.org/wiki/Steinmetz_solid, 7 pages.

* cited by examiner

FLUID END WITH TRANSITION SURFACE GEOMETRY

FIELD OF INVENTION

The present invention relates to the field of high pressure reciprocating pumps and, in particular, to fluid ends of high pressure reciprocating pumps that include grooves for receiving spring retainers therein.

BACKGROUND

High pressure reciprocating pumps are often used to deliver high pressure fluids during earth drilling operations. A reciprocating pump includes a fluid end that defines several different internal bores, adjacent ones of which intersect. In fluid ends with intersecting bores, the corners at which the bores intersect are typically stress concentration points. High stresses are due to the internal pressure in the pump and the fluid that is being pumped. The concentration of stress on the intersection corners negatively impacts the fatigue life of a pump fluid end and the quality of the finished fluid end housing or casing. It is typical practice to hand grind in a transitional radius at an intersecting corner to try to reduce the stress at the corner.

In fluid ends with intersecting bores, an intersecting corner is formed that is not uniform. As a result, a person must hand-finish the corner in a radiused shape to soften the transition from one bore to the adjacent bore. The hand-finished radius introduces a significant amount of irregularity from fluid end to fluid end and is also physically demanding on the hand-finisher. In addition, the hand-finishing process increases the cost and time to manufacture and machine fluid ends. In some instances, the corners and/or the process by which the corners are manufactured are improved, which lengthens the life span of the fluid end. However, such techniques may make it difficult to install valve retainers (e.g., suction valve spring retainers), such as those disclosed in U.S. Pat. Nos. 7,186,097 and 9,732,746, both of which are hereby incorporated by reference in entirety, therein. Thus, further improvements are continually desired.

SUMMARY

The present application relates to a fluid end of a reciprocating pump that includes a housing defining multiple bores extending therein. Adjacent bores intersect each other at a crossbore, and the intersection of two adjacent bores forms an intersection corner, which is where a concentration of high stress occurs during operation of the pump. One of the bores has a first tapered portion to provide a transition that reduces the concentration of stress on the intersection corners, as well as a second tapered portion that forms a ledge with an adjacent bore. The ledge cooperatively formed by the bores creates a sufficiently long arc length to secure a retainer therein. Thus, retainer support within the crossbore is improved, while the impact and concentration of the stress is reduced via the tapered portions of the bore, thereby improving or lengthening the lifetime of the material in that intersection corner of the fluid end. The foregoing advantages and features will become evident in view of the drawings and detailed description.

In one embodiment, a fluid end includes a first bore extending through the fluid end and having a first main cylindrical portion and a tapered portion, a second bore extending through the fluid end and having a second main cylindrical portion, and a crossbore at which the first bore intersects the second bore. The second main cylindrical portion of the second bore terminates at the crossbore to form a ledge in the crossbore, and the tapered portion of the first bore and the second main cylindrical portion of the second bore cooperatively define a peak extending inwardly to the crossbore.

In another embodiment, a method for manufacturing a fluid end includes forming a first bore with a main cylindrical portion and forming a second bore to intersect with the first bore at a crossbore of the fluid end. Forming the second bore includes forming a tapered portion of the second bore, the tapered portion reducing a cross-sectional area of the second bore along the tapered portion toward the crossbore. The tapered portion and the main cylindrical portion cooperatively define a peak that extends inwardly to the crossbore.

In a further embodiment, a fluid end includes a first bore with a cylindrical portion and a second bore extending through the fluid end and intersecting the first bore at a crossbore. The first bore includes a first tapered portion increasing a cross-sectional area of the second bore along the first tapered portion toward the crossbore, the first bore includes a second tapered portion reducing the cross-sectional area of the second bore along the second tapered portion toward the crossbore, and the second tapered portion interfaces with the main cylindrical portion of the first bore.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a fluid end of a reciprocating pump. Each of the different embodiments of fluid ends presented herein have multiple bores formed therein, and adjacent bores intersect each other. The intersection of two adjacent bores forms an intersection corner, which is where a concentration of high stress occurs during operation of the pump. The particular shape and geometry of the intersection corner determines the impact of the stress and the level of concentration of stress on the intersection corner. By improving the shape and geometry of the intersection corner, the impact and concentration of the stress can be reduced, thereby improving or lengthening the lifetime of the material in that intersection corner of the fluid end. With the techniques presented herein, a novel geometry reduces the stress at one or more of the intersection corners while reducing the amount of hand-finishing required and increasing the circumferential engagement between the fluid end and a valve retainer (e.g., a valve spring retainer) installed therein. Moreover, such advantages can be achieved while a bore closure element (e.g., a plug) extends a minimal amount into the crossbore/pumping chamber.

As is detailed herein, the geometry presented herein provides tapered sections at the transition areas between a first bore (e.g., a vertical bore) and a second bore (e.g., a horizontal bore). When viewed from above via a horizontal section view, the new geometry resembles an M shape or "M-shaped configuration." The tapered sections reduce the amount of material that needs to be manually removed from the pumping chamber, such as via hand-finishing. Using less human activity (hand-finishing) and more machining time improves the consistency of the finished fluid end products and cases manufacture of the fluid end, making the geometry presented herein superior to currently available hand-finished products. The tapered sections also improve the fatigue life of fluid ends of reciprocating pumps, as well as the quality of the finished fluid end block. However, the techniques presented herein do not add significant cost into the machining of the fluid end or negatively impact the serviceability of the fluid end. Furthermore, the tapered sections increase a surface area available for engagement with a valve retainer. For example, the tapers may form at least a portion of a ledge so that the ledge has an increased arc length to provide a groove that can better capture the valve retainer. Consequently, the tapered sections improve securement of the valve retainer within the fluid end.

Figure 1A:
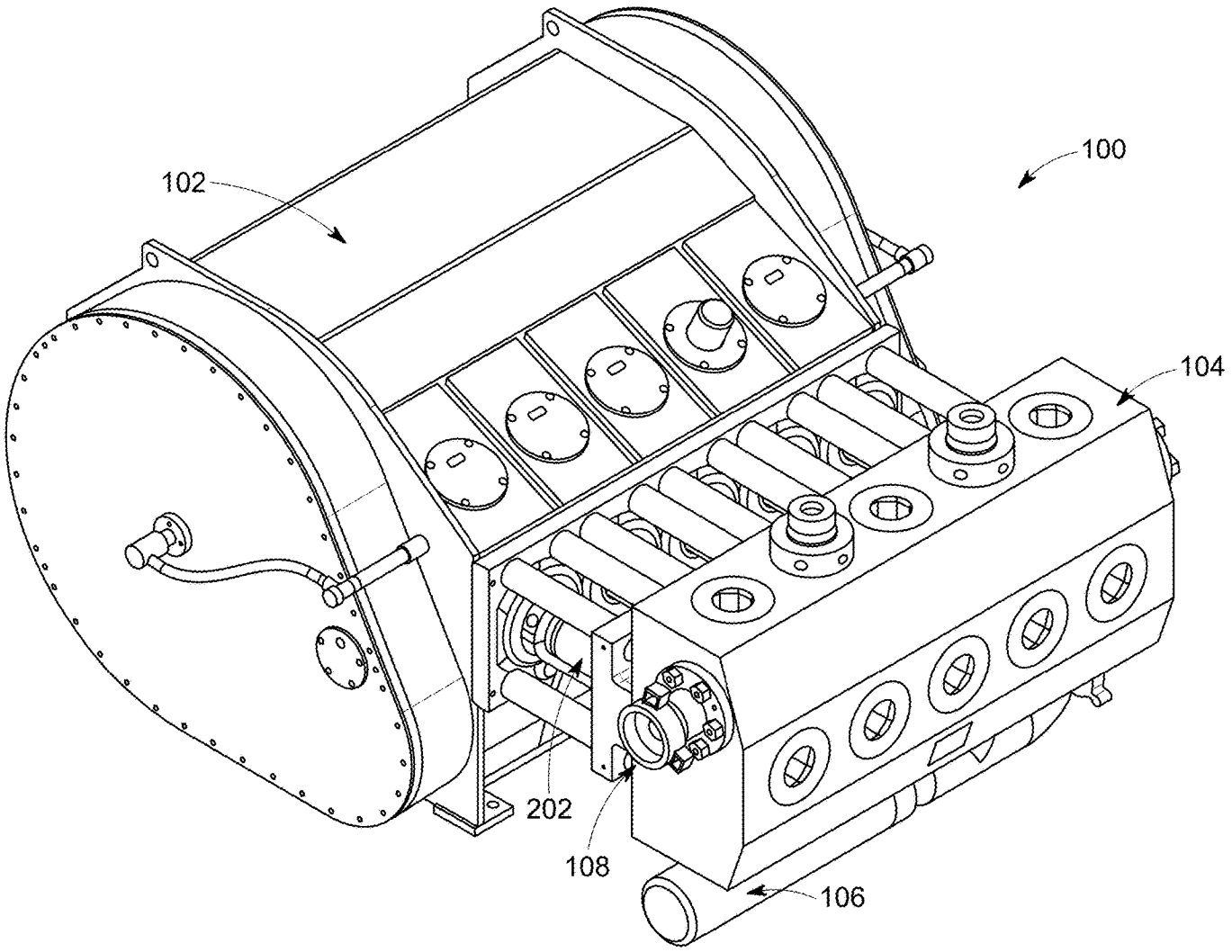
FIG. 1A PRIOR ART
FIG. 1A is a perspective view of a prior art reciprocating pump including a fluid end.
Figure 1B:
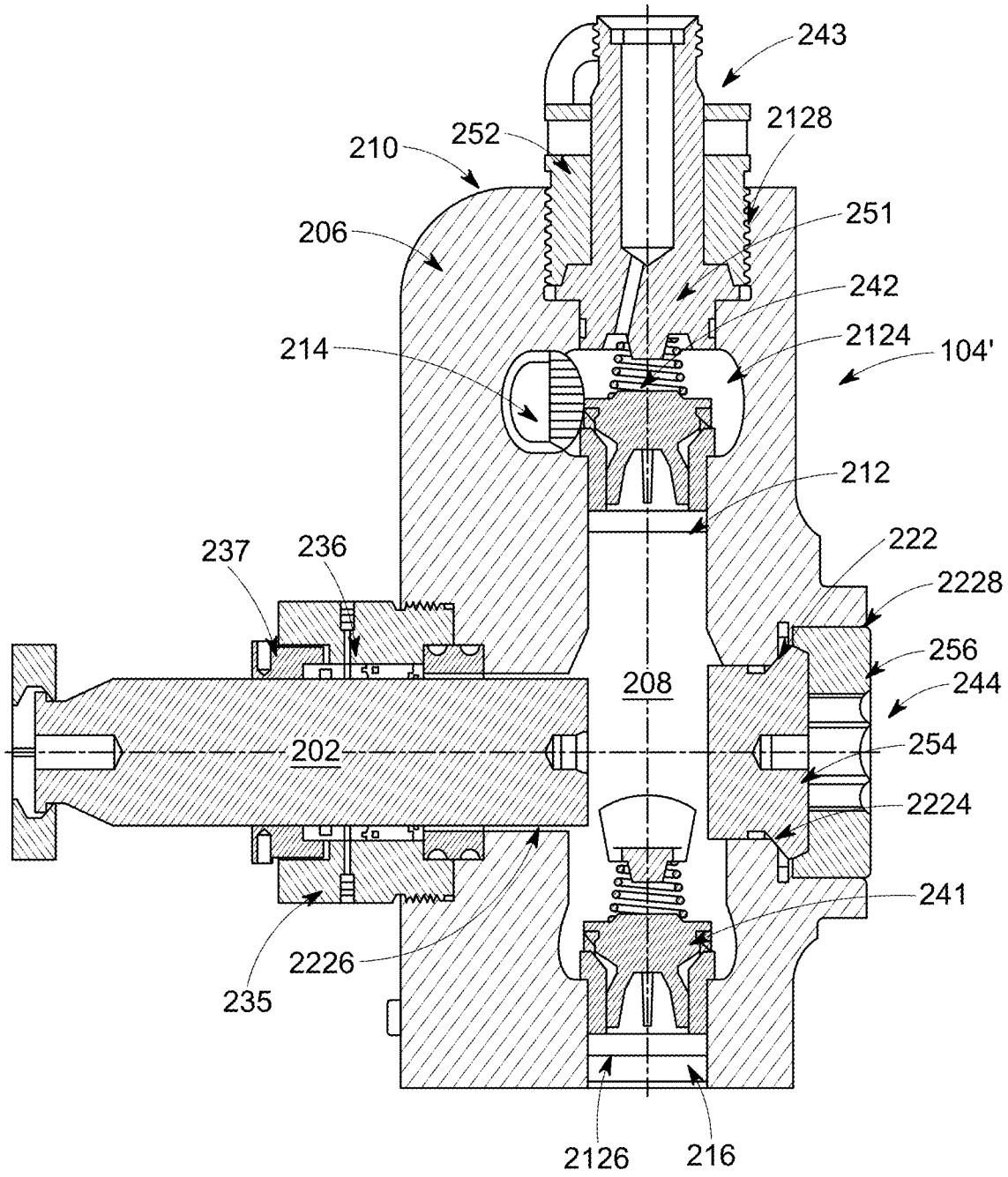
FIG. 1B PRIOR ART
FIG. 1B is a schematic, side sectional view of a fluid end of another prior art reciprocating pump.
Figure 2A:
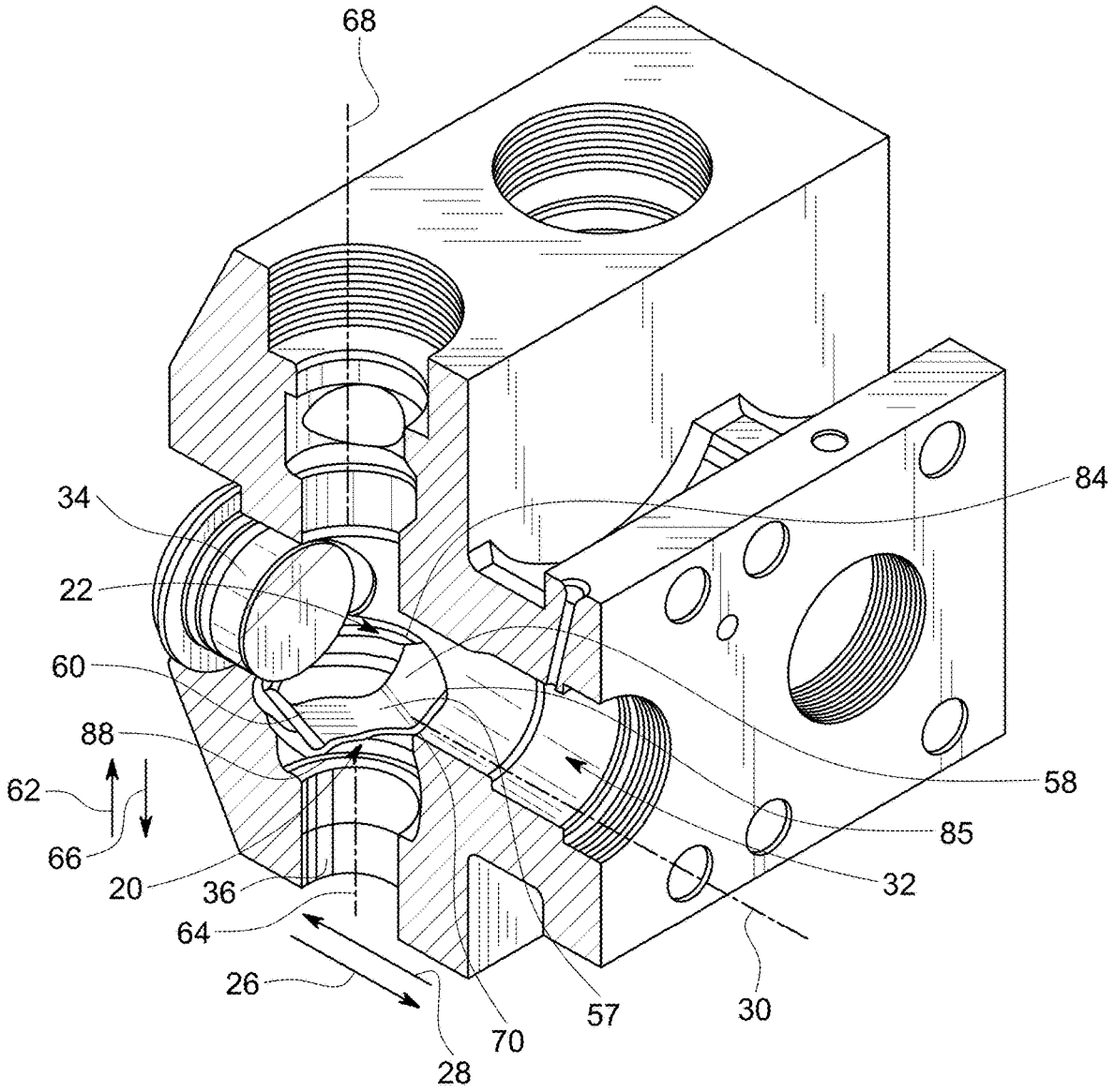
FIG. 2A PRIOR ART
FIG. 2A is a schematic, isometric sectional view of yet another prior art fluid end including a spring retainer and a retainer groove configured to receive the spring retainer.
Figure 2B:
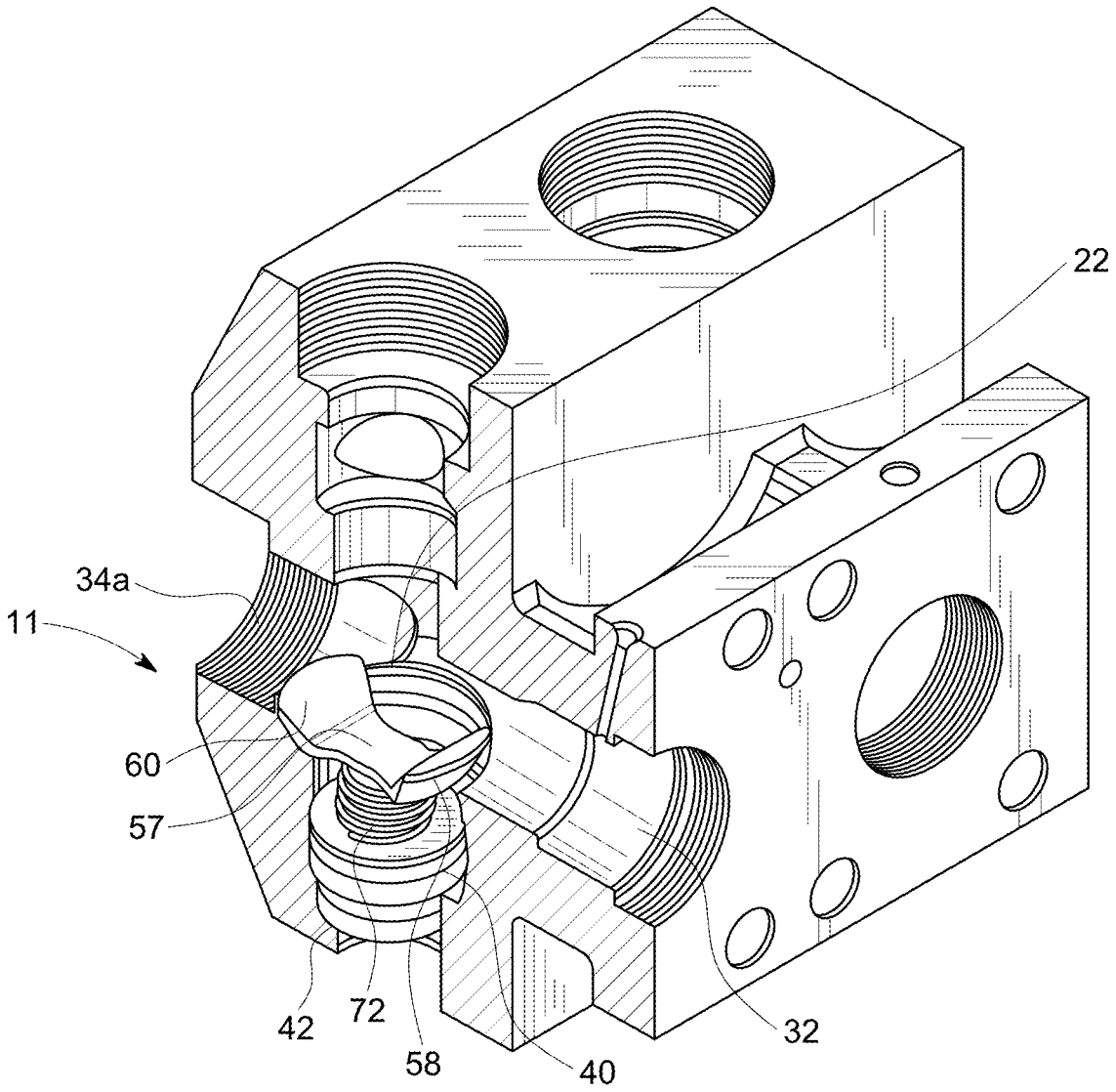
FIG. 2B PRIOR ART
FIGS. 2B and 2C are additional schematic, sectional views of the fluid end of FIG. 2A taken perpendicular to a reciprocation bore of this fluid end that show fluid end components in various states of installation.
Figure 2C:
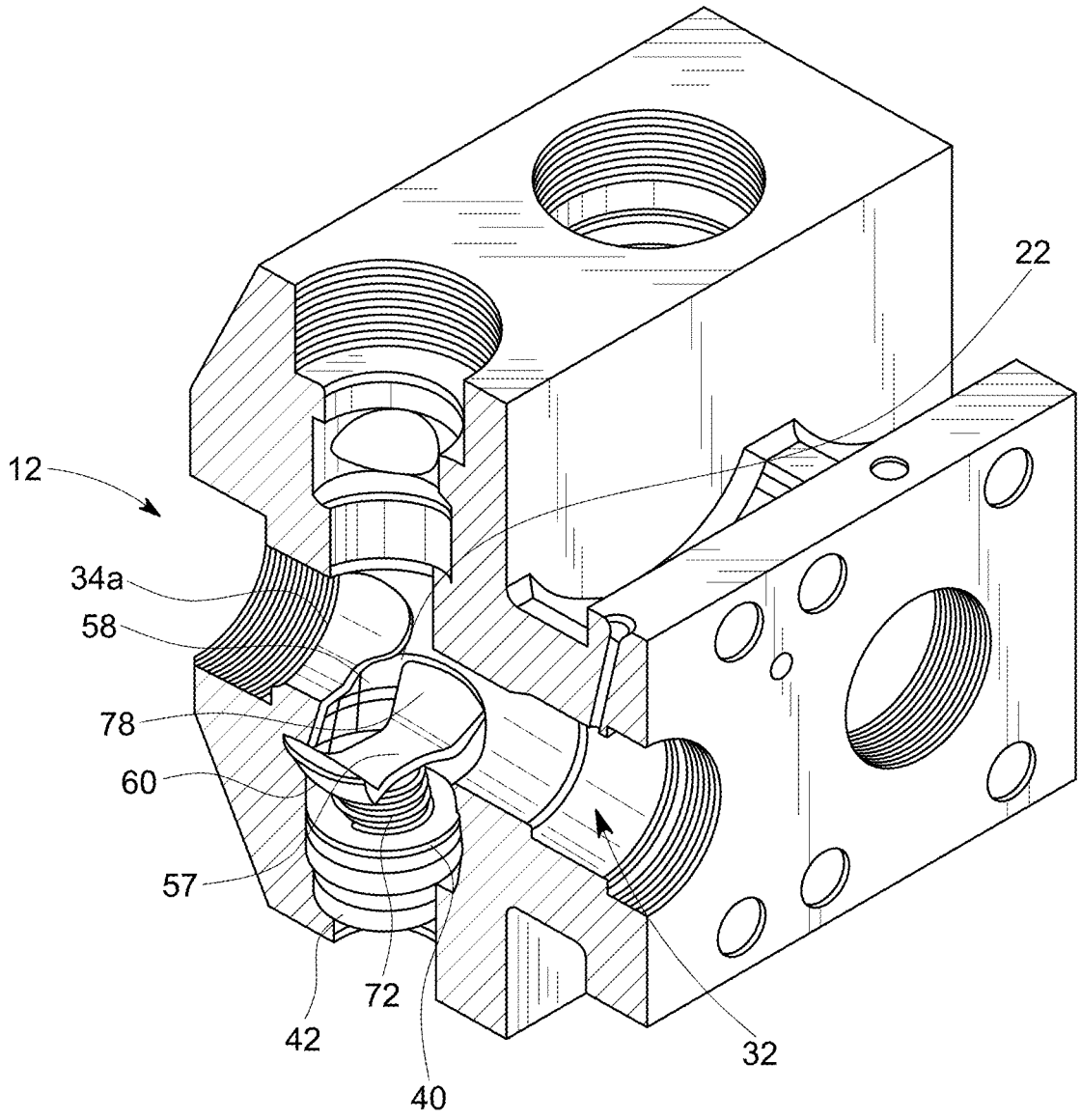
FIG. 2C PRIOR ART
Figure 3:
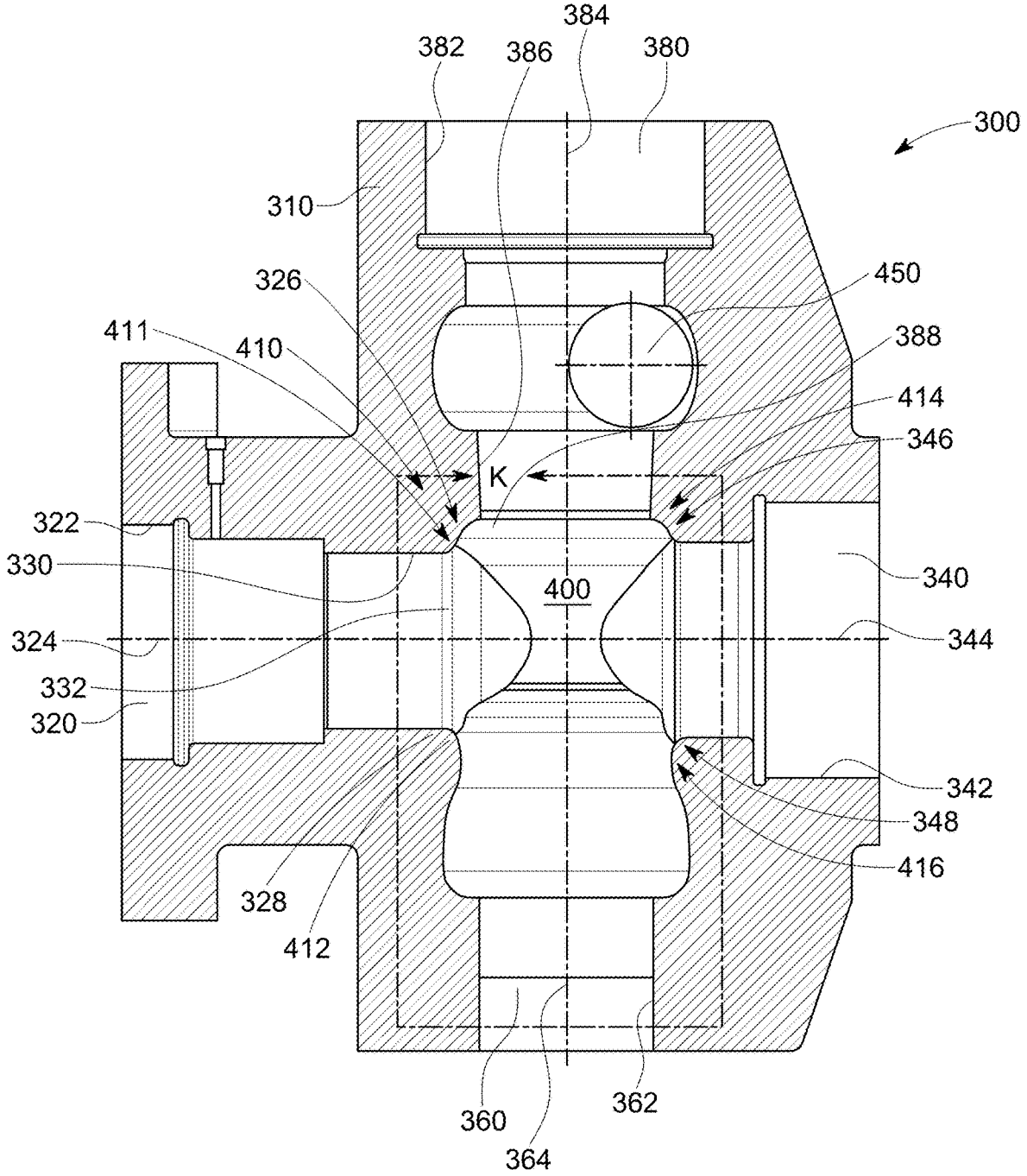
FIG. 3 PRIOR ART
FIG. 3 is a schematic, side cross-sectional view of yet another prior art fluid end.

To best understand the techniques presented herein, it is important to understand operations of fluid ends, as well as certain features that have developed over time. Accordingly, FIGS. 1A and 1B illustrate a preexisting fluid end and describe its parts and components at a relatively high-level. Then, FIGS. 2A-2C illustrate a preexisting fluid end to demonstrate how certain retainers (e.g., spring retainers) may be installed and secured within a fluid end to support a biased valve in an intake bore segment of a fluid end. This fluid end and components thereof are illustrated and described in further detail in U.S. Pat. No. 9,732,746, which is hereby incorporated by reference in its entirety. However, for completeness, certain aspects of this patent are also discussed herein. Meanwhile, FIG. 3 illustrates another preexisting fluid end to demonstrate modifications that may made to the pumping chamber to improve the wear properties and manufacturability, among other advantages, but that may also realize advantages by incorporating features of embodiments disclosed herein. Further details relating to such preexisting embodiments may be found in U.S. application Ser. Nos. 18/326,312 and 17/972,717, which were respectively filed on May 31, 2023 and Oct. 25, 2022. The disclosures of each of these applications are hereby incorporated by reference in entirety. Again, for completeness, certain aspects of these applications are also discussed herein. Still further, further examples of pump fluid ends are disclosed in U.S. Pat. Nos. 9,383,015 and 10,337,508, the disclosures of each of which are also incorporated by reference herein in their entirety.

That all said, FIG. 1A illustrates a prior art reciprocating pump 100. The reciprocating pump 100 includes a power end 102 and a fluid end 104. The power end 102 includes a crankshaft that drives a plurality of reciprocating elements within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations, among other operations.

Often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, especially typical "wear" components, and extend the time between maintenance operations (i.e., between downtime) are highly desirable.

Still referring to FIG. 1A, but now in combination with FIG. 1B, in various embodiments, the fluid end 104 may be shaped differently and/or have different features, but may still generally perform the same functions, define similar structures, and house similar components. To illustrate potential shape variations, FIG. 1B shows a side, cross-sectional view of a fluid end 104' with different internal and external shaping as compared to fluid end 104. However, since fluid end 104 and fluid end 104' have many operational similarities, FIGS. 1A and 1B are labeled with the same reference numerals and are both described with respect to these common reference labels.

The cross-sectional view of FIG. 1B is taken along a central axis of one of the reciprocating elements 202 included in reciprocating pump 100. Thus, although FIG. 1B depicts a single pumping chamber 208, it should be understood that a fluid end 104 can include multiple pumping chambers 208 arranged side-by-side. In fact, in at least some embodiments (e.g., the embodiment of FIG. 1A), a casing 206 of the fluid end 104 forms a plurality of pumping chambers 208, and each chamber 208 includes a reciprocating element 202 (e.g., a plunger) that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged. However, the fluid within the pumping chamber 208 often contains abrasive material (i.e., "debris") that can damage seals in the reciprocating pump 100. Additionally, pressurizing the fluid creates stress that can concentrate within the pumping chamber(s).

As can be seen in FIG. 1B, the pumping paths and pumping chamber 208 of the fluid end 104' are formed by conduits that extend through the casing 206 to define openings at an external surface 210 of the casing 206. More specifically, a first conduit 212 extends longitudinally (e.g., vertically) through the casing 206 while a second conduit 222 extends laterally (e.g., horizontally) through the casing 206. Thus, the first conduit 212 intersects the second conduit 222 to at least partially (and collectively) define the pumping chamber 208. In the prior art fluid end 104 and prior art fluid end 104', conduits 212 and 222 are substantially cylindrical, but the diameters of conduit 212 and conduit 222 may vary throughout the casing 206 so that conduits 212 and 222 can receive various structures, such as sealing assemblies, valves, or components thereof. For example, although not shown in FIG. 1B, conduits 212 and/or 222 can support a spring retainer in or adjacent pumping chamber 208 that allows a valve 241 to control a flow of fluid through an intake segment 2126 of conduit 212, as is detailed below.

Regardless of the diameters of conduit 212 and conduit 222, each conduit 212 and 222 may include two segments, each of which extends from the pumping chamber 208 to the external surface 210 of the casing 206 and may also be referred to as a bore. Specifically, the first conduit 212 includes a first segment 2124 and a second segment 2126 that opposes the first segment 2124. Likewise, the second conduit 222 includes a third segment 2224 and a fourth segment 2226 that opposes the third segment 2224. In the illustrated embodiment, the segments of a conduit (e.g., segments 2124 and 2126 or segments 2224 and 2226) are substantially coaxial while the segments of different conduits are substantially orthogonal. However, in other embodiments, segments 2124, 2126, 2224, and 2226 may be arranged along any desired angle or angles, for example, to intersect pumping chamber 208 at one or more non-straight angles.

In this embodiment, the first conduit 212 defines a fluid path through the fluid end 104. The second segment 2126 is an intake segment that connects the pumping chamber to a piping system 106 delivering fluid to the fluid end 104. Meanwhile, the first segment 2124 is an outlet or discharge segment that allows compressed fluid to exit the fluid end 104. Thus, in operation, segments 2126 and 2124 may include valve components 241 and 242, respectively, (e.g., one-way valves) that allow segments 2126 and 2124 to selectively open. Valve components 241 in the second segment 2126 may be secured therein by a piping system 106 (see FIG. 1A). Meanwhile, valve components 242 in the first segment 2124 may be secured therein by a closure assembly 243 that, in the prior art example illustrated in FIG. 1B, includes a closure element 251 (also referred to as a discharge plug) that is secured in the first segment 2124 by a retaining assembly 252. The prior art retaining assembly 252 is coupled to the first segment 2124 via threads 2128 defined by an interior wall of the first segment 2124.

On the other hand, the fourth segment 2226 defines, at least in part, a cylinder for reciprocating elements 202 and/or connects the casing 206 to a cylinder for reciprocating element 202. For example, in the illustrated embodiment, a casing segment 235 is secured to the fourth segment 2226 and houses a packing assembly 236 configured to seal against a reciprocating element 202 disposed interiorly of the packing assembly 236. In any case, reciprocation of a reciprocating element 202 in or adjacent to the fourth segment 2226, which may be referred to as a reciprocation segment, draws fluid into the pumping chamber 208 via the second segment 2126 and pumps the fluid out of the pumping chamber 208 via the first segment 2124. Notably, in the illustrated prior art arrangement, the packing assembly 236 is retained within casing segment 235 with a retaining element 237 that is threadedly coupled to casing segment 235.

The third segment 2224 is an access segment that can be opened to access parts disposed within casing 206 and/or surfaces defined within casing 206. During operation, the third segment 2224 may be closed by a closure assembly 244 that, in the prior art example illustrated in FIG. 1B, includes a closure element 254 (also referred to as a suction plug) that is secured in the third segment 2224 by a retaining assembly 256. Notably, the prior art retaining assembly 256 is coupled to the third segment 2224 via threads 2228 defined by an interior wall of the third segment 2224. However, in some embodiments, the second conduit 222 need not include the third segment 2224 and the second conduit 222 may be formed from a single segment (the fourth segment 2226) that extends from the pumping chamber 208 to the external surface 210 of casing 206.

Overall, in operation, fluid may enter fluid end 104 (or fluid end 104') via multiple openings, as represented by opening 216 in FIG. 1B, and exit fluid end 104 (or fluid end 104') via multiple openings, as represented by opening 214 in FIG. 1B. In at least some embodiments, fluid enters openings 216 via pipes of piping system 106, flows through pumping chamber 208 (due to reciprocation of a reciprocating element 202), and then flows through openings 214 into a channel 108. However, piping system 106 and channel 108 are merely example conduits and, in various embodiments, fluid end 104 may receive and discharge fluid via any number of pipes and/or conduits, along pathways of any desirable size or shape.

Also, during operation of pump 100, the first segment 2124 (of the first conduit 212), the third segment 2224 (of the second conduit 222), and the fourth segment 2226 (of the second conduit 222) may each be "closed" segments. By comparison, the second segment 2126 (of the first conduit 212) may be an "open" segment that allows fluid to flow from the external surface 210 to the pumping chamber 208.

That is, for the purposes of this application, a "closed" segment may prevent, or at least substantially prevent, direct fluid flow between the pumping chamber 208 and the external surface 210 of the casing 206, while an "open" segment may allow fluid flow between the pumping chamber 208 and the external surface 210. To be clear, "direct fluid flow" requires flow along only the segment so that, for example, fluid flowing from pumping chamber 208 to the external surface 210 along the first segment 2124 and channel 108 does not flow directly to the external surface 210 via the first segment 2124.

Now turning to FIGS. 2A-2C, these Figures schematically illustrate cross-sectional views of another prior fluid end to illustrate how a retainer may be installed in some fluid ends. The views of FIGS. 2A-2C are illustrated as being taken through the casing of the fluid end of a pump, along a plane parallel to axes 30, 64, and 68 of bore segments which it intersects. For clarity and/or as a result of the sectional views, various components are shown or omitted in FIG. 2A-2C, but such omission should not be interpreted to indicate that such components are or are not included in this art fluid end. For example, for clarity, a reciprocating element, which may be similar to reciprocating element 202 of FIGS. 1A and 1B, is not illustrated in FIGS. 2A-2C. Similarly, FIG. 2A illustrates a plug 34 that is omitted from FIGS. 2B and 2C in order to illustrate certain features of this fluid end. As yet another example, while a retainer 20 is illustrated as being disposed in a retainer groove 22 in FIGS. 2A-2C, the retainer 20 is shown supporting a spring 72 that acts against a valve 40 to bias the valve 40 into a closed position against its valve seat 42 in FIGS. 2B and 2C, but the components with which the retainer 20 interacts are omitted from FIG. 2A for clarity.

Similar to the prior art fluid described in connection with FIGS. 1A and 1B, the fluid end of FIGS. 2A and 2B operates when a reciprocating element reciprocates in a first direction 26 and an opposite second direction 28 along a central axis 30 of bore segment 32. As the reciprocating element reciprocates in the first direction 26, suction valve 40 moves off its valve seat 42 towards the retainer 20 (i.e., suction valve 40 moves out of a closed position). Fluid then passes over/around the retainer 20 into the crossbore or pumping chamber of the fluid end. When the reciprocating element then reciprocates in the opposite second direction 28, the fluid pushes a discharge valve 48 off its valve seat 50 and exits the fluid end via a discharge bore segment (which is centered around axis 68). In the depicted prior art, the fluid end is a single monoblock piece machined from a single casting or forging. However, the fluid end could alternatively have any number of shapes or features, as mentioned above in connection with the prior art of FIGS. 1A and 1B. For example, in other embodiments, the fluid end might be flangeless.

During the aforementioned operations, forces generated by fluid flow may cause the retainer 20 to rotate about its central axis. Such forces may also urge the retainer 20 to move longitudinally, e.g., in direction 62 or 66 along axis 68. Thus, the retainer 20 must be secured in place within the fluid end. In this prior art fluid end, closure element 34 (e.g., a suction plug) and groove 22 extending around a portion of the crossbore provide such securement. However, extension of the groove 22 generally around the crossbore is interrupted by a valve cover transition area 78 and a reciprocation bore transition area 70 so that the groove 22 has two opposing sections. That is, a first portion and a second, opposite portion of groove 22 are not connected; these portions are separated by transition areas 70 and 78, such that the groove 22 is discontinuous. The transition areas 78 and 80 of this embodiment are generally rounded with a valley. Additionally, transition areas 78 and 80 are each coplanar with groove 22 so that a valve cover 34 or reciprocating element installed in the fluid end can extend into a rotational path defined by groove 22. However, before the retainer 20 is secured within the fluid end, the retainer 20 must be installed within the crossbore.

To install the retainer 20, the retainer 20 is first oriented in a first orientation 11 (e.g., a drop-in position or pre-installation position), which is depicted in FIG. 2B. Often, the retainer 20 and the other various portions of a valve assembly (e.g., valve 40, valve seat 42, spring 72, etc.) are installed into bore segment 36 with valve cover 34 and reciprocating element removed or not yet installed into the fluid end. Additionally, the valve 40 and valve seat 42 are typically installed into bore segment 36 before the retainer 20 is installed therein. A spring 72 may be installed with the valve 40 or installed separately from valve 40. Either way, the spring 72 extends from the valve 40 to the retainer 20 after these components are installed within bore segment 36. That all said, when the retainer 20 is in orientation 11, a first retainer portion 58 of the retainer 20 is aligned with a reciprocation bore transition 70 (see FIG. 2A) area so it overlaps transition area 70 and a second spring retainer portion 60 is aligned with a valve cover bore transition area 78 (see FIG. 2C) so it overlaps transition area 78. Accordingly, the retainer 20 can be moved (e.g., pushed) in direction 66, into/towards both the bore segment 36 and the valve 40 installed therein, to compress spring 72. This compression continues until a first retainer portion 58 of retainer 20 abuts a transition area 70 of the fluid end and a second retainer portion 60 of retainer 20 abuts an opposite transition area 78 of the fluid end. These abutments prevent further axial movement of the spring retainer 20 in direction 66.

As can be seen in FIGS. 2A-2C, retainer portions 58 and 60 each comprise extensions (i.e., wings, lips, etc.) that extend from opposite sides of a base portion 57 of retainer 20. Thus, when retainer portions 58 and 60 abut transition areas 70 and 78, the retainer 20 extends across bore segment 36 and can rotate about its central axis atop bore segment 36. This moves retainer portions 58 and 60 of the retainer 20 into a groove 22 that extends around the crossbore/pumping chamber of the fluid end, between first lateral edges of transition areas 70 and 78 and between second lateral edges of transition areas 70 and 78 (with the second lateral edges being opposite the first lateral edges). That is, rotating the retainer 20 around its central axis moves a leading edge 84 (see FIG. 2A) of the first retainer portion 58 into a first portion of groove 22 while simultaneously moving a leading edge 88 (see FIG. 2A) of the second retainer portion 60 into a second portion of the groove 22. Thus, rotating the retainer portions 58 and 60 out of contact with transition areas 70 and 78 moves the retainer 20 into an engaged or installed position 12, an example of which is shown in FIG. 2C.

As mentioned, when properly installed, the retainer 20 is secured in the fluid end, e.g., in its installed position 12. First, the groove 22 engages retainer portions 58 and 60 to prevent axial movement of the retainer along axes 64/68 in direction 62, while the spring 72 acts against the retainer 20 to discourage the retainer 20 from moving axially along axes 64/68 in direction 66. That is, the spring 72 biases the retainer 20 into engagement with groove 22 to axially secure the retainer 20 within the fluid end (e.g., within or adjacent to the crossbore/pumping chamber). Additionally or alternatively, different portions or sections of retainer 20 may include geometry (e.g., rounding, sloping, etc.) configured to engage corresponding geometries of the fluid end to axially secure the retainer 20. Second, after the retainer 20, valve 40, valve seat 42, and other corresponding parts are installed within bore segment 36, a valve cover 34 is installed into valve cover bore transition area 78 via access segment 34*a*, providing a rotational stop that prevents retainer portions 58 and 60 from rotating from one of the sections of groove 22 to the other. That is, once installed, valve cover 34 limits the range of rotation of retainer 20 to less than 180 degrees and prevents valve cover 34 from moving back into its first orientation 11. Thus, retainer 20 cannot move into an orientation—i.e., orientation 11—that disengages the retainer 20 from groove 22 and allows the retainer 20 to be removed from the fluid end.

Now turning, to FIG. 3, as mentioned above, this Figure schematically illustrates another preexisting fluid end 300 to illustrate an example geometry that may improve the cross-bore/pumping chamber of the fluid end 300. In this view, closure and retaining assemblies have been removed from the fluid end 300 to facilitate the description thereof. The casing or housing 310 of fluid end 300 includes a plunger or power end bore 320 that is a bore for a reciprocating member, such as a plunger. The plunger bore 320 has an inner wall or surface 322 that defines the plunger bore 320. The plunger bore 320 also has a plunger axis or centerline 324 that extends therethrough. The casing 310 includes a valve cover or access bore 340, which is defined by an inner surface or surface 342 and has a centerline or axis 344. In this embodiment, valve cover bore 340 does not include a threaded region for the mounting of various fluid end components, but in other embodiments, threads may be formed on inner surface 342. In this embodiment, centerline 344 of the valve cover bore 340 is aligned with centerline 324 of the plunger bore 320; but bores 320 and 340 need not always be aligned.

The fluid end casing 310 also includes an inlet bore 360 that is defined by an inner wall or surface 362 and has a centerline or axis 364. The casing 310 also includes a discharge bore 380 that is defined by an inner wall or surface 382 and has a centerline or axis 384. The discharge bore 380 is in fluid communication with a fluid outlet 450, and the centerline 364 of bore 360 is aligned with centerline 384 of the discharge bore 380, but, again, these bores 360 and 380 need not always be aligned. The bores 320, 340, 360, and 380 of the casing 310 converge to a common intersection, referred to as a crossbore or crossbore intersection 400. The crossbore intersection 400 (i.e., the pumping chamber) defines an open space in housing 310. Between each pair of intersecting adjacent bores 320, 340, 360, and 380 is an intersection corner that has a transition area that includes a surface. Each of these intersections is briefly described in turn below.

First, bores 320 and 380 are adjacent to each other and intersect, thereby forming a corner or intersection or overlapping corner 326. Corner 326 includes a transition area 410 between the corners of bores 320 and 380. Second, bores 320 and 360 are adjacent to each other and intersect, thereby forming a corner or intersection corner 328. Corner 328 includes a transition area 412 between the corners of bores 320 and 360. Often, surfaces located at the intersection of adjacent bores in a fluid end casing experience a high concentration of stresses due to the internal pressure and the particular fluid being pumped. In this embodiment, intersection corners 326 and 328 (i.e., the corners bordering plunger bore 320), with their respective transition areas 410 and 412, are locations at which the concentration of stresses is high during operation of the pump.

Third, bores 340 and 380 are adjacent to each other and intersect, thereby forming a corner or intersection or overlapping corner 346. Corner 346 includes a transition area 414 between the corners of bores 340 and 380. Fourth, and finally, bores 340 and 360 are adjacent to each other and intersect, thereby forming a corner or intersection corner 348. Corner 348 includes a transition area 416 between the corners of bores 340 and 360. Intersection corners 346 and 348 (i.e., the corners bordering valve cover bore 340) are locations at which the concentration of stresses is high during operation of the pump, just like intersection corners 326 and 328.

In one embodiment, the inner wall or surface 322 of the plunger bore 320 includes a first portion 330 that has a first inner diameter and a second portion 332 that has a second inner diameter. The second inner diameter is larger than the first inner diameter. The surface 322 transitions from the first portion 330 to the second portion 332. The second portion 332 includes a curved surface that is defined by a radius. Similarly, the inner wall or surface 382 of the discharge bore 380 includes a first portion 386 that has an inner diameter and a second portion 388 that has an inner diameter. The inner diameter of the second portion 388 is larger than the inner diameter of the first portion 386. In addition, the surface 382 transitions from first portion 386 to second portion 388. The second portion 388 also includes a curved surface that is defined by a radius. In this embodiment, the curved surface radius of the second portion 388 of the discharge bore 380 is a different length than the curved surface radius of the second portion 332 of the plunger bore 320. In addition, surface 322 and surface 382 converge with each other at a convex point at the first transition area between bore 320 and 380.

To reduce the stresses on the surfaces inside of the casing 310, and in particular, on the intersection or overlapping corners between adjacent bores, this embodiment provides machined surfaces located in the transition areas between adjacent bores. If a plane was created using the axes 324, 344, 364, and 384, the profiles of the bores 320, 340, 360, and 380 intersect at substantially tangent points along such a plane. For manufacturability, it is helpful for each intersection point to be a slightly raised point relative to the surrounding surfaces, so the intersection point can be easily hand-finished or easily knocked down with a sanding tool. If an intersection point is sunken relative to the surrounding surfaces, it is challenging to soften the transition between the two intersecting bores.

In the illustrated embodiment, the intersection point falls on an intersection line that travels along the cross-bore intersection at all points where the vertical bores intersect with the horizontal bores. The intersection points are the locations that experience the highest stress for the cross-bore intersection. By providing a substantially tangent surface, the stress is reduced in those locations. As one moves along each intersecting bore transition line away from a central intersection point, the intersection between the intersecting horizontal and vertical bores become "less tangent" where the stress in the crossbore intersection 400 is lower. In this embodiment, the upper transition areas 410 and 414 are formed in a similar manner to formation of the lower transition areas 412 and 416.

In this embodiment, the transition areas 410 and 414 are formed generally similar to each other. Also, transition areas 412 and 416 are formed generally similar to each other, but they have a different shape or configuration than transition areas 410 and 414, as shown. None of the transition areas 410, 412, 414, or 416 has a profile that matches a hemisphere or partial sphere profile. Instead, a slightly raised feature 411 is formed by the surfaces of adjacent intersecting bore at transition area 410. Each of the other transition areas 412, 414, and 416 may have a slightly raised feature as well.

To manufacture a fluid end with the geometry shown in FIG. 3, a first bore is initially machined in the fluid end housing. In one embodiment, the first bore is formed so that it has an inner surface that transitions from a first portion with a first inner diameter to a second portion with a second inner diameter. The second inner diameter is larger than the first inner diameter. Next, a second bore is machined in the housing. Similar to the first bore, the second bore is formed with an inner surface that transitions from a third portion with a third inner diameter to a fourth portion with a fourth inner diameter, and the fourth inner diameter is larger than the third inner diameter. When the first bore and the second bore are machined, the fourth portion of the second inner surface intersects with the second portion of the first inner surface at a first intersection corner. At that first intersection corner, the fourth portion and the second portion collectively form a slightly raised feature.

In one embodiment of the invention, approximately 90% of the manufacturing steps for forming the first bore and the second bore is accomplished via machining processes. Then, the remaining polishing to reduce raised points at the intersections of adjacent bores is accomplished by hand-finishing. In one embodiment, an operator reaches through a third bore to hand-finish an intersecting corner between other adjacent, intersecting bores. In another embodiment, an intersection area to be hand-finished is accessed by reaching through one of the adjacent, intersecting bores. In any case, this embodiment provides interior surfaces for bores having a geometry to reduce stresses on the fluid end 300 caused by fluidic pressures. In particular, the geometry of FIG. 3 attempts to minimize operating stresses in the lower quadrant (or hemisphere) of the crossbore intersection 400 and improve the fatigue life of the fluid end 300. The hemispherical transition surfaces tend to reduce the stress concentration at the crossbore intersection 400 by smoothing the geometry of the inlet bore 360 and improving the distribution of the load around the crossbore intersection 400.

Unfortunately, the hand-finishing process used to form fluid end 300 can be cumbersome and time consuming, as well as subject to human error. Thus, increasing manufacturing that can be accomplished via machining processes, rather than manual processes, can improve manufacture of a fluid end. Moreover, the geometry of the fluid end 300 may not fully secure a valve retainer therein to the extent desired. For instance, while some preexisting fluid ends (e.g., FIGS. 2A-2C) allow valve retainers to be securely installed in a fluid end and others (e.g., FIG. 3) change the geometry of the pumping chamber to reduce stress concentrations, pursuing the advantages of both of these preexisting fluid ends has proven problematic. More specifically, often, to securely retain a valve retainer in a fluid end groove, the valve retainer should be at least 50% circumferentially engaged in its groove when its rotation is arrested by interfering with the valve cover. This is often accomplished by balancing the arc length of the groove with the length of the valve cover that extends into the crossbore. However, when the geometry of the crossbore is changed to reduce stress, it can reduce an available arc length of the groove to achieve the 50% circumferential engagement. Indeed, often the only way to compensate for the reduced circumferential engagement caused by such a change in geometry of the crossbore is to extend the valve cover further into the crossbore. This is undesirable, both because it is difficult to install and service a valve cover in such a position and because a valve cover extending substantially into the crossbore can potentially impact a forwardly stroking reciprocating element. Indeed, contact between the valve cover and the reciprocating element is highly undesirable as it can damage parts of the pump and/or enhance wear. Alternatively, a valve cover extending substantially into the crossbore might shorten the maximum stroke length for a reciprocating element, which would limit the effectiveness of a pump and/or limit the configurations/assemblies/applications in which a fluid end could be used. For example, the fluid end might only be usable with a limited number of power ends, only usable for certain applications up to threshold pressures, etc.

Figure 4:
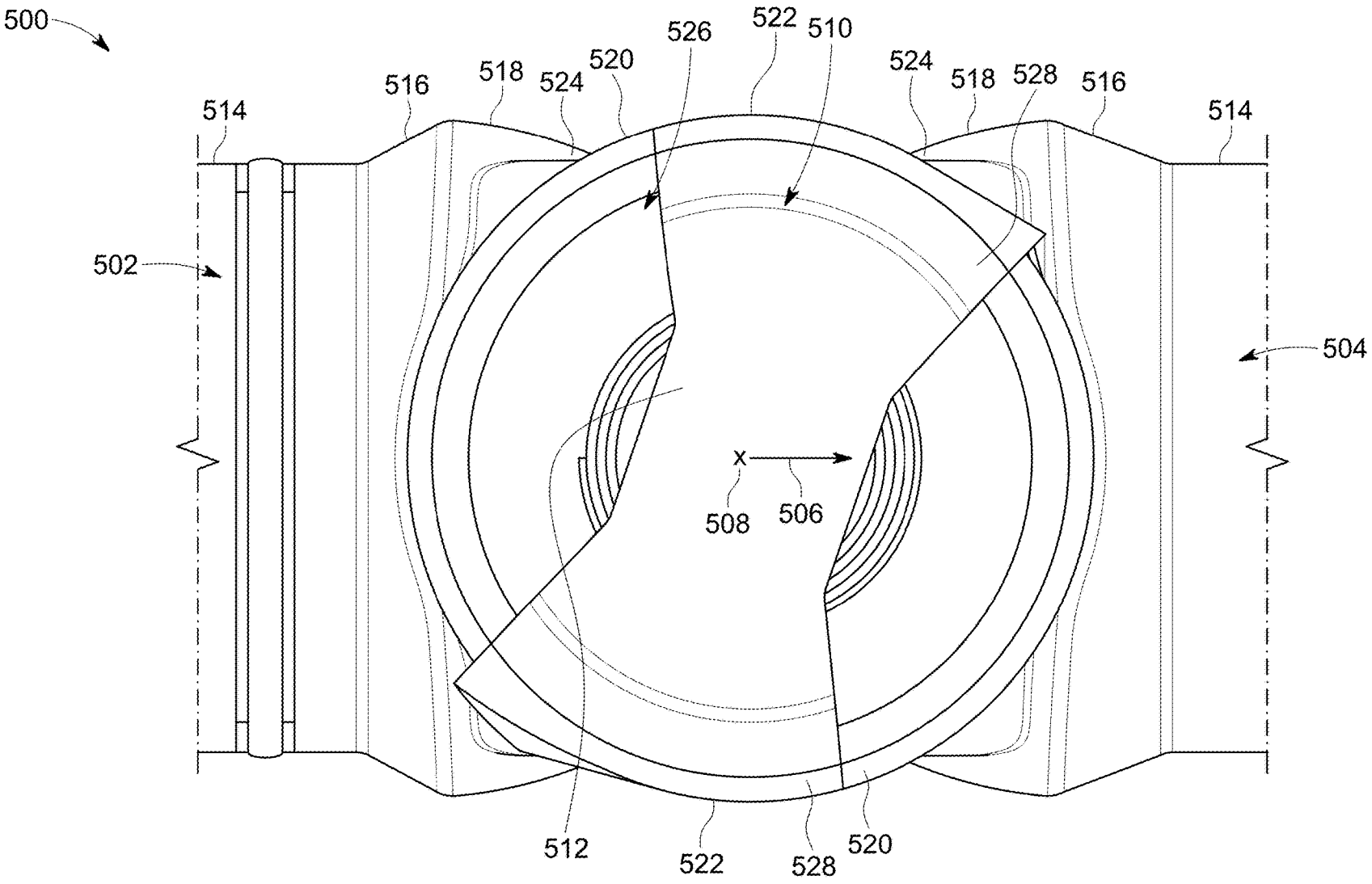
FIGS. 4 and 5 illustrate top, sectional views of a fluid end having a crossbore geometry presented herein, according to an example embodiment.

The crossbore geometry presented in this application resolves these issues, and an example crossbore geometry is shown in FIG. 4, which is a top, sectional view of a fluid end 500. The fluid end 500 includes a first bore 502 (e.g., a plunger bore, a first horizontal bore) and a second bore 504 (e.g., a suction bore, an access bore, a second horizontal bore) extending along a first axis 506 (e.g., a horizontal axis). The fluid end 500 also includes bores (not shown) extending along a second axis 508 (e.g., a vertical axis). These bores 502, 504 intersect at a crossbore 510 of the fluid end 500. A valve retainer 512 is secured within the crossbore 510.

Each of the bores 502 and 504 includes a first main cylindrical portion 514, and a cross-sectional geometry of the bores 502 and 504 remains substantially the same (e.g., having the same circular shape) along the first main cylindrical portions 514. Additionally, each of the bores 502 and 504 includes a first tapered portion 516 extending from the first main cylindrical portion 514 toward the crossbore 510. The cross-sectional area of the bores 502 and 504 increases along the first tapered portion 516 toward the crossbore 510, and the first tapered portions 516 provide a transition from the bores 502 and 504 into the crossbore 510 to reduce stress concentrations. In particular, the increase in cross-sectional area of the bores 502 and 504 provided by the first tapered portions 516 reduces a geometric discontinuity (e.g., there is no sharp corner) where the bore 502 and 504 intersect with other bores (not shown), such as vertical bores, and/or the crossbore 510. Therefore, the first tapered portions 516 can reduce wear of the fluid end 500.

Furthermore, each of the bores 502 and 504 includes a second tapered portion 518 extending from the first tapered portion 516 toward the crossbore 510. The cross-sectional area of the bores 502 and 504 decreases along the second tapered portion 518 toward the crossbore 510. Each second tapered portion 518 intersects with the bore extending along the second axis 508 (i.e., each tapered portion 518 independently intersects the same vertical bore). Specifically, a bore extending along the second axis 508 includes a second main cylindrical portion 520, which terminates at the crossbore 510 to form ledge 522 and define a groove 526. The second main cylindrical portion 520 and the second tapered portions 518 of the bores 502 and 504 converge with one another to form peaks 524 of the ledge 522 extending inwardly (e.g., at least one vector component of the extension extends substantially transverse to the first axis 506) toward the crossbore 510 about the second main cylindrical portion 520. The second main cylindrical portion 520 and the adjacent peaks 524 cooperatively form an M-shaped configuration. In certain embodiments, the M-shaped configuration is symmetrical (e.g., the first tapered portions 516 have substantially the same orientation, the second tapered portions 518 have substantially the same orientation, the adjacent peaks 524 have substantially the same geometry). In alternative embodiments, the M-shaped configuration is asymmetrical (e.g., the first tapered portions 516 have different orientations, the second tapered portions 518 have different orientations, the adjacent peaks 524 have different geometries). That is, to be clear, even though tapered portions 518 are labeled with like numerals, the tapered portions need not be the same.

In the illustrated embodiment, each of the first tapered portion 516 and the second tapered portion 518 extends arcuately. For example, to provide a sufficiently smooth transition that reduces stress concentrations, the first tapered portion 516 may have a first radius that is greater than a second radius of the second tapered portion 518. However, in alternative embodiments, the first tapered portion 516 and the second tapered portion 518 may have any suitably sized radii, such as similar radii. Alternatively, tapered portions 516 and 518 need not have a single radii and/or need not be arcuate. That is, tapered portions 516 and 518 can be formed from compound radii, from linear and arcuate shapes, or any other desired geometries, and, to reiterate, tapered portions 518 need not be the same in terms of shape, size, etc.

The groove 526 defined by the ledge 522 is configured to receive the valve retainer 512, thereby securing the valve retainer 512 within the fluid end 500, such as at least partially within the crossbore 510. For example, the ledges 522, including the peaks 524, may capture retainer portions 528 of the valve retainer 512 while the valve retainer 512 is in an installed configuration in the fluid end 500 to block rotation of the valve retainer 512 and maintain engagement of the valve retainer 512 to the ledges 522.

Figure 5:
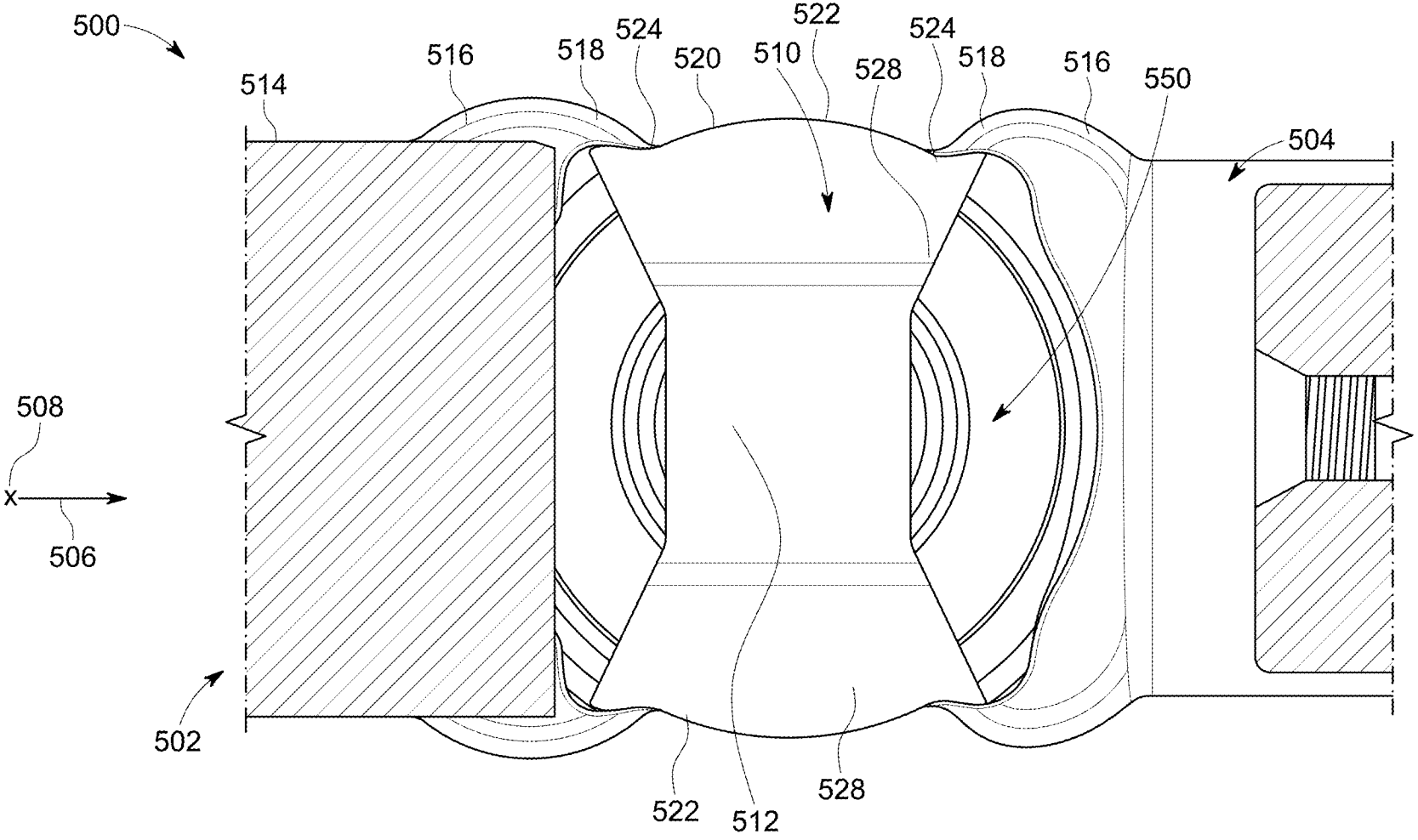

FIG. 5 illustrates the fluid end 500 with the valve retainer 512 in an installed configuration 550. Thus, the retainer portions 528 of the valve retainer 512 are in engagement with the ledges 522, including the peaks 524. As can be seen, the second tapered portions 518 reduce the cross-sectional area of the bores 502 and 504 and increase an arc length of the ledges 522, thereby increasing an available surface area to engage the valve retainer 512 and arrest axial movement of the valve retainer 512. That is, because the second tapered portions 518 provide the inwardly extending peaks 524, the ledges 522 can better surround the retainer portions 528 for increased circumferential engagement. In turn, this ensures the retainer portions 528 remain engage with ledges 522 and cannot slip or otherwise move past ledges 522. By way of example, by extending inward toward the crossbore 510, the second tapered portions 518 may compensate for the first tapered portions 516 that extend outward away from the crossbore 510 and otherwise would reduce an available surface area for engagement with the retainer portions 528. For instance, the peaks 524 formed by the second tapered portions 518 and the second main cylindrical portion 520 may extend inwardly beyond the first main cylindrical portions 514 of the bores 502 and 504 to achieve desirable engagement of the valve retainer 512.

For example, approximately 55% or more, approximately 65% or more, approximately 75% or more, or even approximately 85% or more of the circumference of the valve retainer 512 may be engaged in the groove 526 of the crossbore geometry presented herein. For example, one retainer portion 528 spans an arc of approximately 67.5 degrees, and approximately 55% or more, approximately 65% or more, approximately 75% or more, or even approximately 85% or more of this arc may be engaged by a corresponding ledge 522 presented herein.

Implementing the second tapered portions 518 enables a geometry of the first tapered portion 516 to be more flexibly established. For example, a length of extension of the first tapered portions 516 and/or a degree of extension of the first tapered portions 516 can be increased to provide a sufficiently smooth transition to reduce stress concentrations, and the second tapered portions 518 can be correspondingly manufactured to extend inwardly and provide the ledge 522 and the peaks 524 oriented to achieve desirable engagement of the valve retainer 512. Therefore, the first tapered portions 516 can be manufactured in a suitable manner to reduce stress concentrations with limited hand-finishing without reducing securement of the valve retainer 512 in the fluid end 500.

Figure 6:
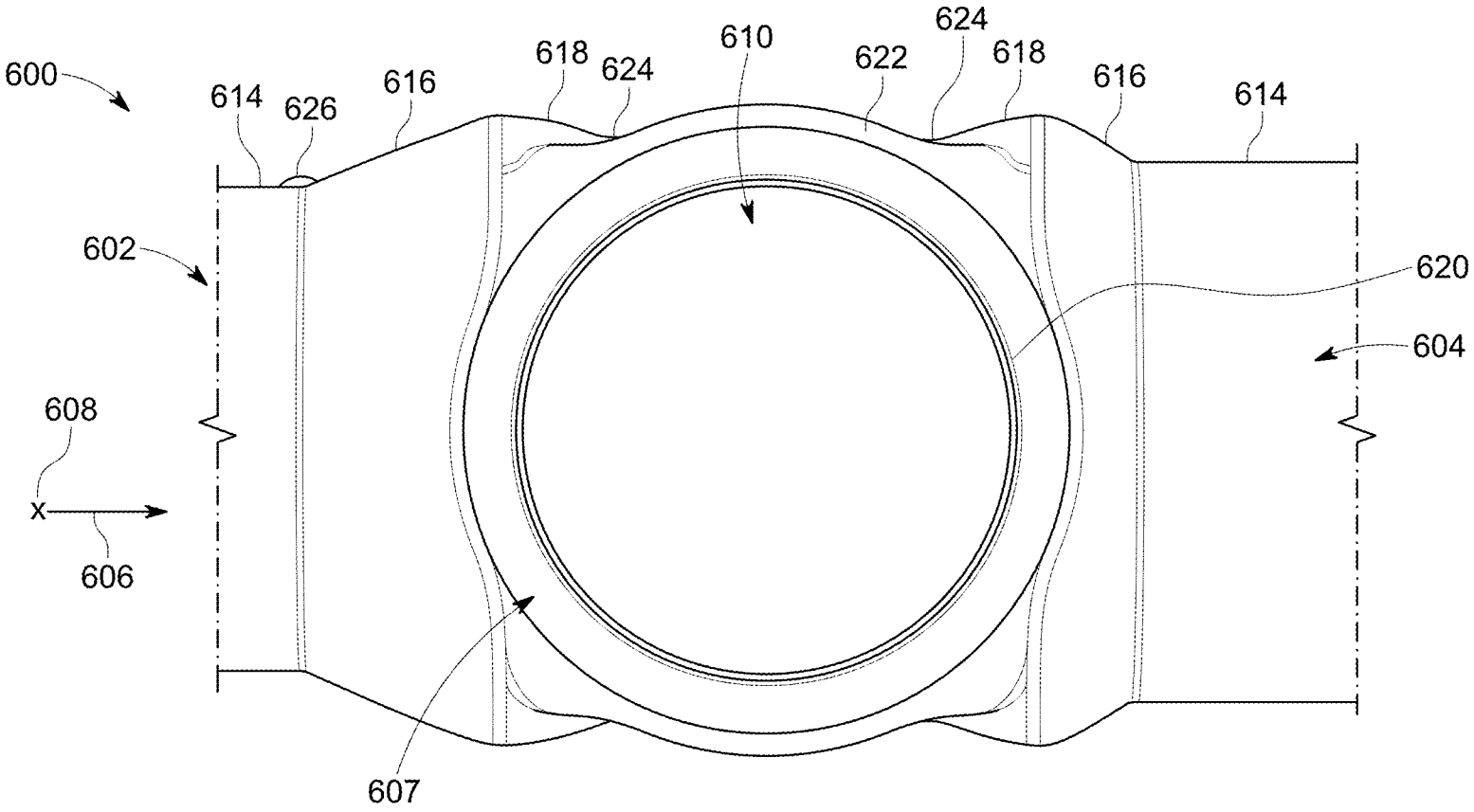
FIG. 6 illustrates a bottom, sectional view of another fluid end having a crossbore geometry presented herein, according to an example embodiment.

FIG. 6 is a bottom, sectional view of a fluid end 600. The fluid end 600 includes a first bore 602 (e.g., a plunger bore, a first horizontal bore) and a second bore 604 (e.g., a valve cover bore, a second horizontal bore) extending along a first axis 606 (e.g., a horizontal axis). The fluid end 600 also includes a third bore 607 extending along a second axis 608 (e.g., a vertical axis). These bores 602, 604, and 607 intersect at a crossbore 610 of the fluid end 600.

Each of the bores 602 and 604 includes a first main cylindrical portion 614, and a cross-sectional geometry of the bores 602 and 604 remains substantially the same along the first main cylindrical portions 614. Additionally, each of the bores 602 and 604 includes a first tapered portion 616 extending from the first main cylindrical portion 614 toward the crossbore 610 to increase a cross-sectional area of the bores 602 and 604 along the first tapered portions 616 toward the crossbore 610, thereby providing a transition from the bores 602 and 604 into the crossbore 610 to reduce stress concentrations. Furthermore, each of the bores 602 and 604 includes a second tapered portion 618 extending from the first tapered portion 616 toward the crossbore 610 to decrease the cross-sectional area of the bores 602 and 604 along the second tapered portions 618 toward the crossbore 610. The third bore 607 includes a second main cylindrical portion 620, which terminates at the crossbore 610 to form ledges (not shown) configured to capture a valve retainer (not shown) disposed within the crossbore 610. The second main cylindrical portion 620 and the second tapered portions 618 of the bores 602 and 604 converge with one another to form peaks 624 extending inwardly toward the crossbore 610 about the second main cylindrical portion 620, thereby forming an M-shaped configuration.

In this embodiment, the first tapered portions 616 extend linearly, whereas the second tapered portions 618 extend arcuately. For example, the first tapered portions 616 may form a sufficient angle 626 with a corresponding first main cylindrical portion 614 (e.g., with the first axis 606) to expand the cross-sectional area of the bores 602 and 604 to provide a smooth transition that reduces stress concentrations. Additionally, the second tapered portions 618 extend inwardly to increase an arc length of the ledges, thereby increasing an available surface area for engagement with the valve retainer (e.g., to compensate for the extension of the first tapered portions 616).

Figure 7:
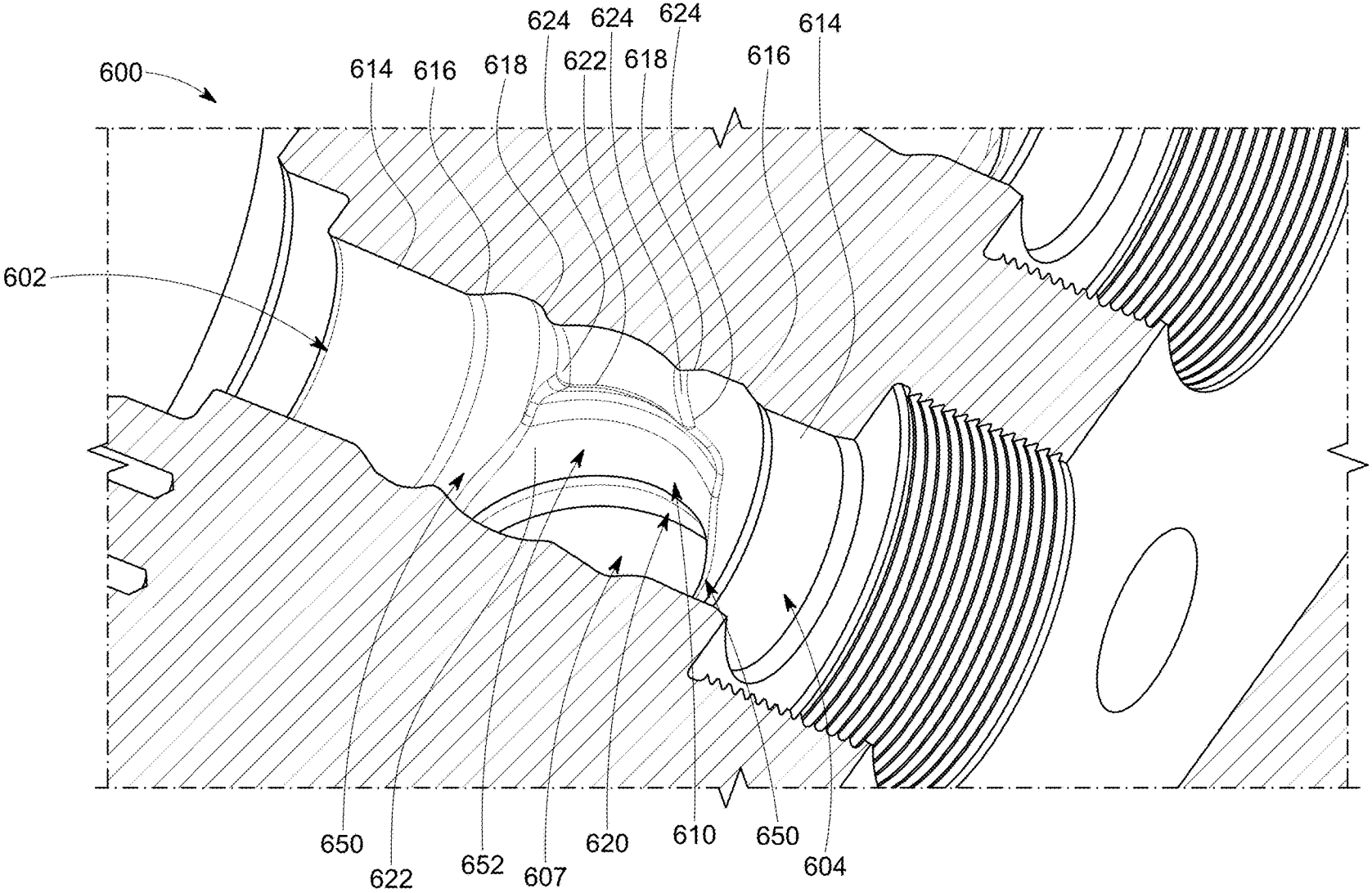
FIG. 7 illustrates a perspective, sectional view of the fluid end of FIG. 6.

FIG. 7 is a perspective, sectional view of the fluid end 600, illustrating the intersection of the bores 602, 604, and 607. In particular, the bores 602 and 604 intersect with the third bore 607 to form respective corners 650, and the second tapered portions 618 of the bores 602 and 604 interface with the second main cylindrical portion 620 of the third bore 607 to form the peaks 624. The tapered portions 616 and 618 form a transition area that reduces stress concentrations without having to be hand-finished. For example, the tapered portions 616 and 618 can be manufactured with a machine process, such as without creating a raised features to be subsequently reduced via hand-finishing. Thus, an ease of manufacture of the fluid end 600 is improved. The ledge 622 with peaks 624 provided by intersection of the bores 602 and 604 with the third bore 607 defines a groove 652 configured to receive a valve retainer (e.g., the valve retainer 512), and the peaks 624 provide a sufficient surface area of engagement with the valve retainer to secure the valve retainer in the groove 652.

Figure 8:
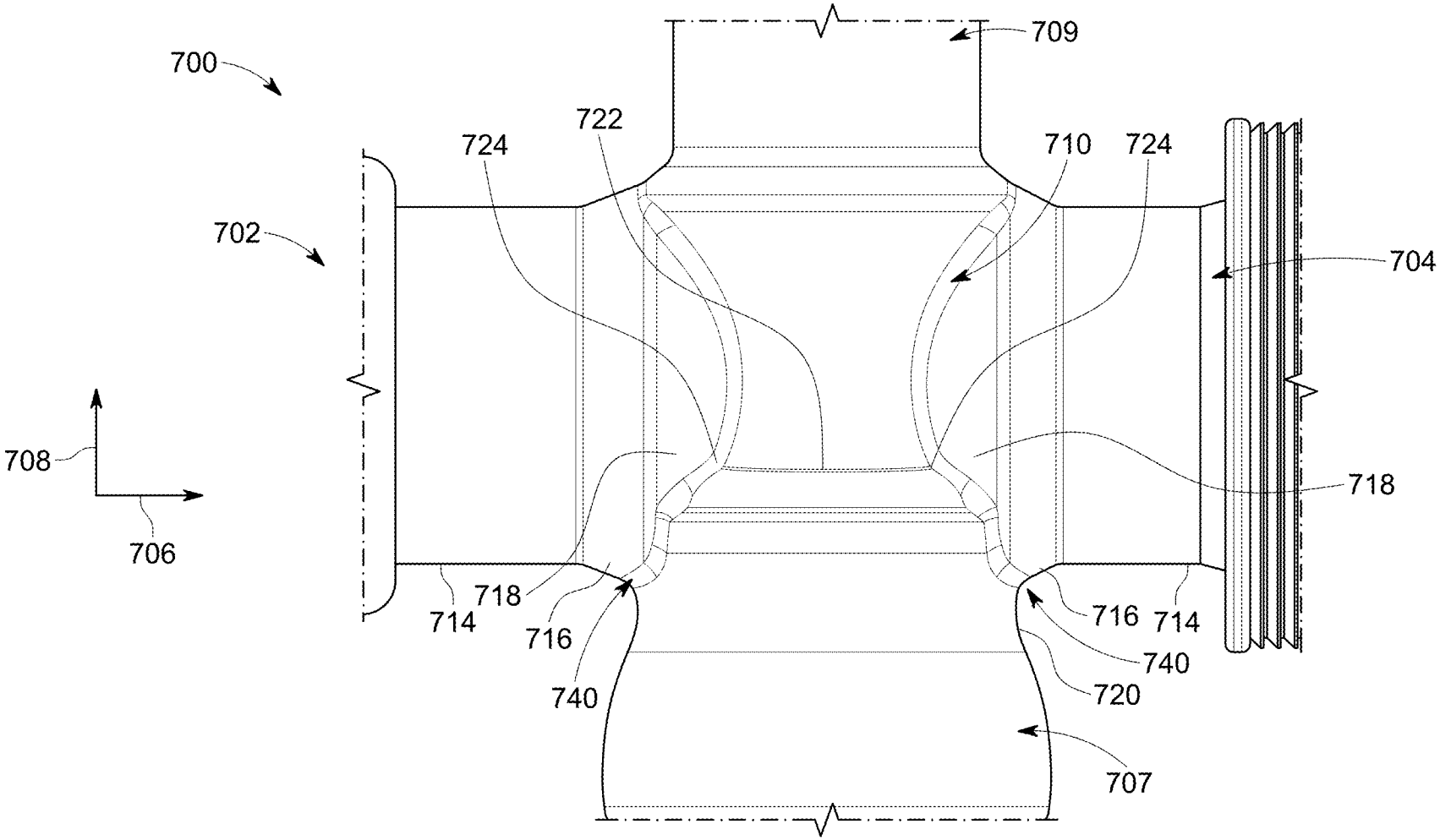
FIG. 8 illustrates a side, sectional view of yet another fluid end having a crossbore geometry presented herein, according to an example embodiment.

FIG. 8 is a side, sectional view of a fluid end 700 (e.g., the fluid end 500, the fluid end 600) having a first bore 702 (e.g., a plunger bore, a first horizontal bore) and a second bore 704 (e.g., a valve cover bore, a second horizontal bore) extending along a first axis 706 (e.g., a horizontal axis), as well as a third bore 707 and a fourth bore 709 extending along a second axis 708 (e.g., a vertical axis). The bores 702, 704, 707, and 709 intersect at a crossbore 710 of the fluid end 700.

Each of the bores 702 and 704 includes a first main cylindrical portion 714, a first tapered portion 716 extending from the first main cylindrical portion 714 toward the crossbore 710 to increase a cross-sectional area of the bores 702 and 704 along the first tapered portions 716 toward the crossbore 710, and a second tapered portion 718 extending from the first tapered portion 716 toward the crossbore 710 to decrease the cross-sectional area of the bores 702 and 704 along the second tapered portions 718 toward the crossbore 710. The third bore 707 includes a second main cylindrical portion 720 terminating at the crossbore 710 to form ledges 722 configured to capture a valve retainer (not shown) disposed within the crossbore 710. The second main cylindrical portion 720 and the second tapered portion 718 of the bores 702 and 704 converge with one another to form peaks 724 extending inwardly toward the crossbore 710 about the second main cylindrical portion 720, thereby forming an M-shaped configuration.

The bores 702 and 704 intersect with the third bore 707 to form a corner 740. However, the first tapered portions 716 provide a smoother transition from the bores 702 and 704 to the crossbore 710 at the corner 740. For instance, the first tapered portions 716 create a smoother/rounder corner 740, rather than a sharp edge at where the bores 702 and 704 intersect with the third bore 707, thereby blending the bores 702 and 704 with the third bore 707. In some embodiments, the second tapered portions 718 extend from a part of the first tapered portions 716, rather than from an entirety of the first tapered portions 716. By way of example, the second tapered portions 718 may extend from a specific part of a circumference of the first tapered portions 716 to form the ledges 722 that capture retainer portions of the valve retainer in the installed configuration of the valve retainer, and the second tapered portions 718 do not extend from a remainder of the first tapered portions 716 where ledges are not needed to capture the valve retainer. Consequently, the second tapered portions 718 are specifically implemented to provide the ledges 722 that align with the retainer portions in the installed configuration of the valve retainer. For instance, selectively forming the second tapered portions 718 in this manner provides sufficient clearance within the crossbore 710 (e.g., reduces a volume occupied by the ledges 722) to enable the valve retainer to be inserted into the crossbore 710 and removed from the crossbore 710, while also enabling desirable securement of the valve retainer.

Figure 9:
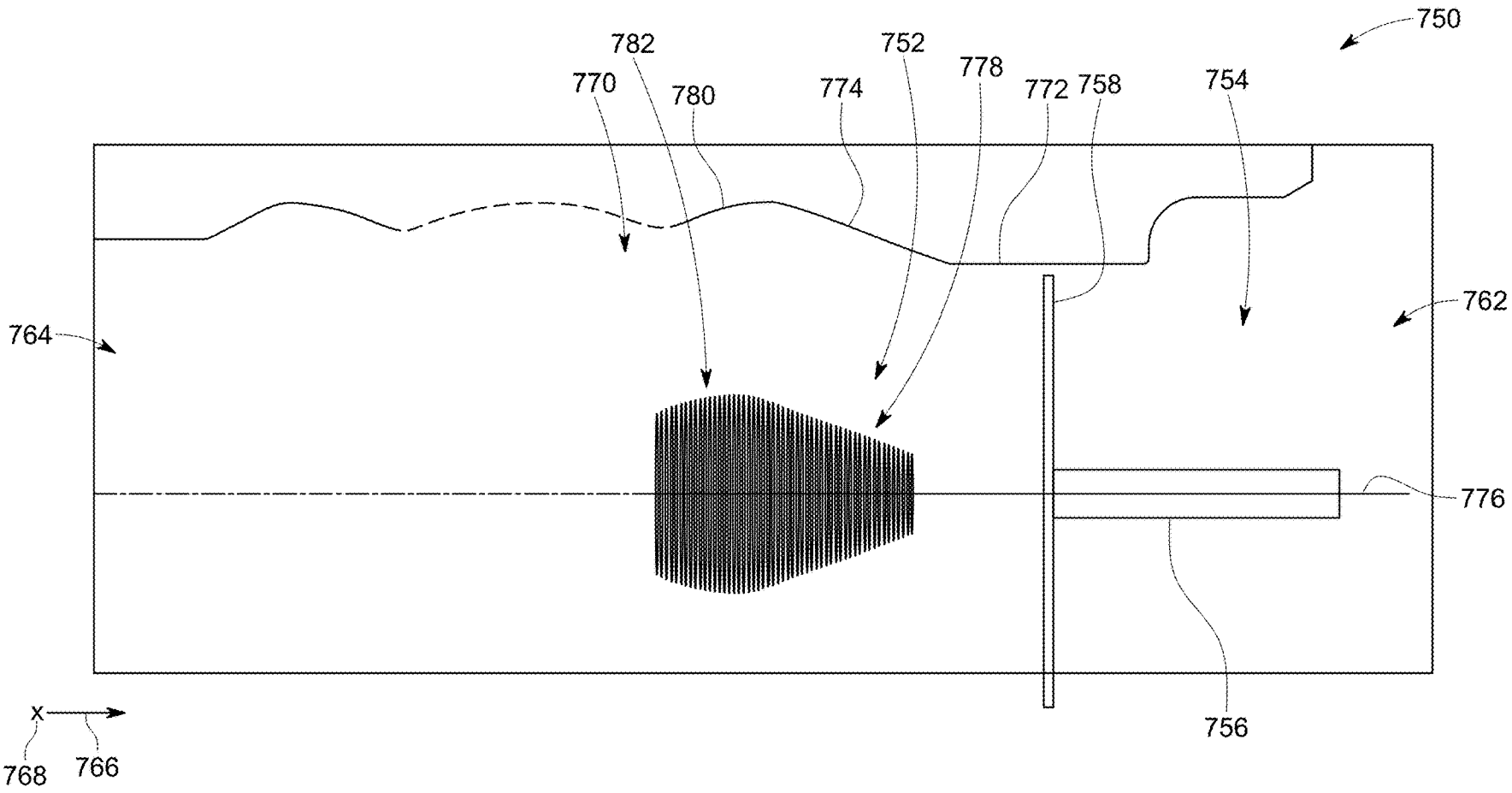
FIG. 9 illustrates a path of a tool for forming a crossbore geometry presented herein, according to an example embodiment.

FIG. 9 illustrates a top view of a fluid end 750, depicting a path 752 for a tool 754 to form the M-shaped configuration within the fluid end 750. The tool 754 includes a shaft 756 attached to a blade 758. The shaft 756 is configured to rotate the blade 758 to provide a cutting action. The fluid end 750 includes a first bore 762 (e.g., a valve cover bore, a first horizontal bore) and a second bore 764 (e.g., a plunger bore, a second horizontal bore) extending along a first axis 766. The fluid end 750 also includes bores (not shown) extending along a second axis 768 (e.g., a vertical axis). These bores 762 and 764 intersect at a crossbore 770 of the fluid end 750.

The first bore 762 includes a main cylindrical portion 772, which may initially extend to the crossbore 770, and the tool 754 is used to form the tapered portions that extend from the main cylindrical portion 720 toward the crossbore 770. Generally, the tool 754 is moved along the path 752 by moving through the first bore 762, toward the crossbore 770 along a center axis 776 of the first bore 762, and around the center axis 776 to move the blade 758 against walls of the first bore 762 to remove material from the walls, thereby adjusting the main cylindrical portion 772 and forming a profile of the tapered portions. In particular, to form the first tapered portion 774, at a first part 778 of the path 752, revolutions of the tool 754 about the center axis 776 increase in size toward the crossbore 770. That is, the tool 754 is moved in an increasing spiral motion, thereby increasing the amount of material removed and increasing a cross-sectional area of the first bore 762 toward the crossbore 770. In the illustrated embodiment, the first tapered portion 774 extends generally linearly. To this end, the revolutions of the tool 754 about the center axis 776 may increase in steady increments (e.g., a circumference/diameter of the revolutions linearly increases toward the crossbore 770). After the first tapered portion 774 has been formed, the tool 754 is moved to form a second tapered portion 780 extending from the first tapered portion 774 via a second part 782 of the path 752 by decreasing the size of the revolutions of the tool 754 about the center axis 776 toward the crossbore 770. That is, the tool 754 is moved in a decreasing spiral motion, thereby decreasing the amount of material removed and decreasing the cross-sectional area of the first bore 762 toward the crossbore 770. For example, the second tapered portion 780 extends arcuately, and the revolutions of the tool 754 about the center axis 776 may decrease in varying increments (e.g., a circumference/diameter of the revolutions exponentially or acceleratingly decreases toward the crossbore 770).

The tool 754 may be moved in a similar manner to form tapered portions of the second bore 764. In some embodiments, the tool 754 is moved from the crossbore 770 through the second bore 764 (e.g., and revolved around a center axis of the second bore 764) to form the tapered portions of the second bore 764. In additional or alternative embodiments, the tool 754 is moved through the second bore 764 (e.g., a main cylindrical portion of the second bore 764) toward the crossbore 770 (e.g., and revolved around a center axis of the second bore 764) to form the tapered portions of the second bore 764.

In any case, such movement of the tool 754 along the path 752 forms the tapered portions 774 and 780 that provide a geometry with reduced stress concentrations and an increased engagement with a valve retainer. Indeed, the tool 754 may be used to form the tapered portions 774 and 780 without having to supplement removing material from the first bore 762 with hand-finishing. That is, the tool 754 alone may sufficiently form the desirable geometry of the fluid end 750 that blends the bores 762 and 764 with corresponding intersecting bores, thereby increasing an case of manufacture of the fluid end 750.

Figure 10:
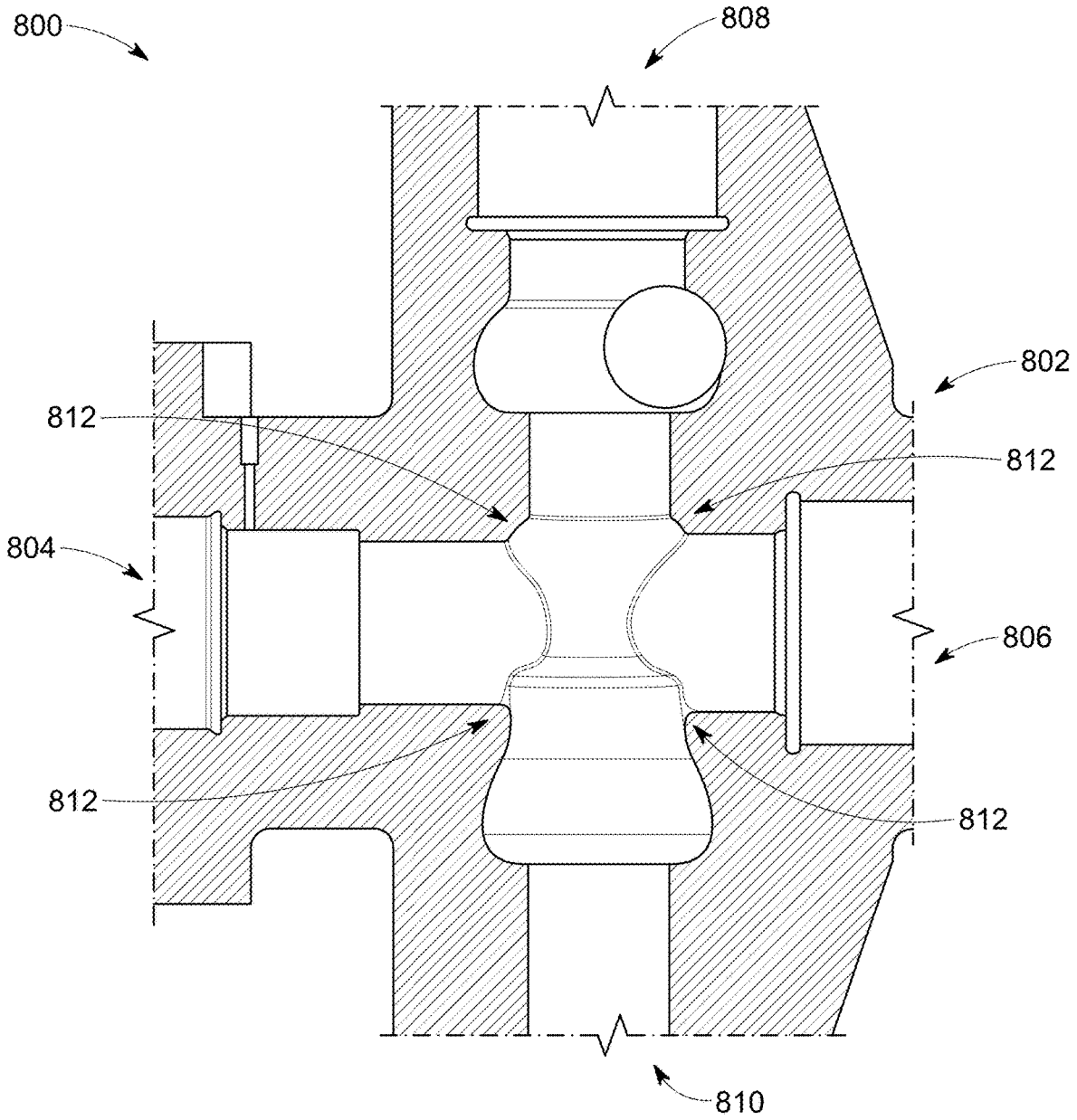
FIG. 10 PRIOR ART
FIGS. 10 and 11 illustrate cross-sectional views of a prior art fluid end and a fluid end with a crossbore geometry presented herein, respectively.
Figure 11:
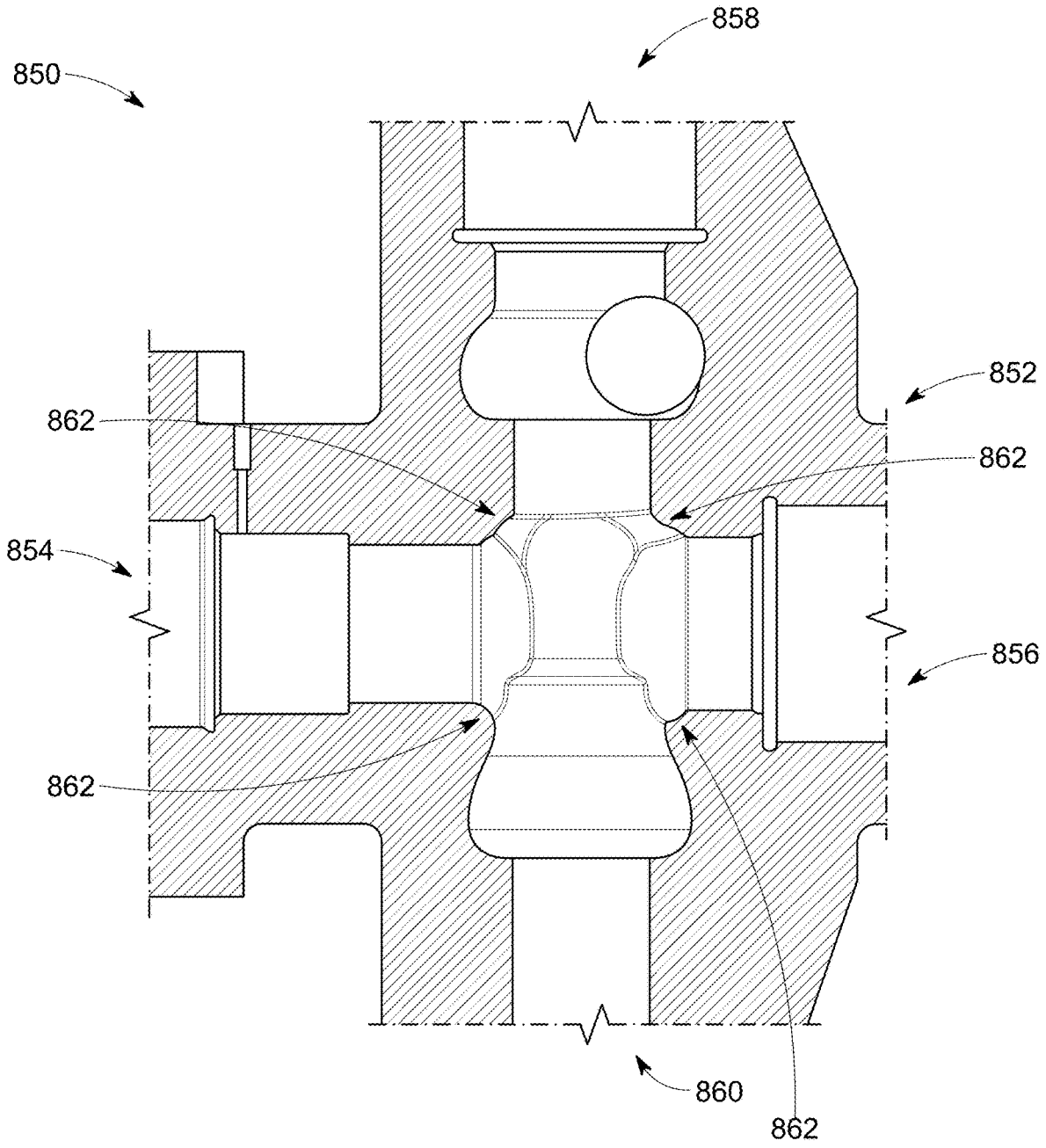

FIGS. 10 and 11 are cross-sectional views to illustrate different crossbore geometries. In particular, FIG. 10 illustrates a cross-sectional side view of a prior art fluid end 802 that has bores 804 and 806 (e.g., horizontal bores) intersecting with bores 808 and 810 (e.g., vertical bores). The fluid end 802 does not include the crossbore geometry disclosed herein (e.g., the bores 804 and 806 do not include tapered portions). Therefore, the bores 804 and 806 intersect with the bores 808 and 810 to form sharp corners 812. The sharp corners 812 are subject to increased stress concentrations, thereby increasing wear of the fluid end 802.

FIG. 11 illustrates a cross-sectional side view of a fluid end 852 that has bores 854 and 856 (e.g., horizontal bores) intersecting with bores 858 and 860 (e.g., vertical bores). The fluid end 852 includes the crossbore geometry disclosed herein (e.g., the bores 854 and 856 include tapered portions). Thus, the bores 854 and 856 intersect with the bores 858 and 860 to form relatively smoothed corners 862, thereby blending the bores 854 and 856 with the bores 858 and 860. The smoothed corners 862 reduce stress concentrations, thereby reducing wear of the fluid end 852.

Figure 12:
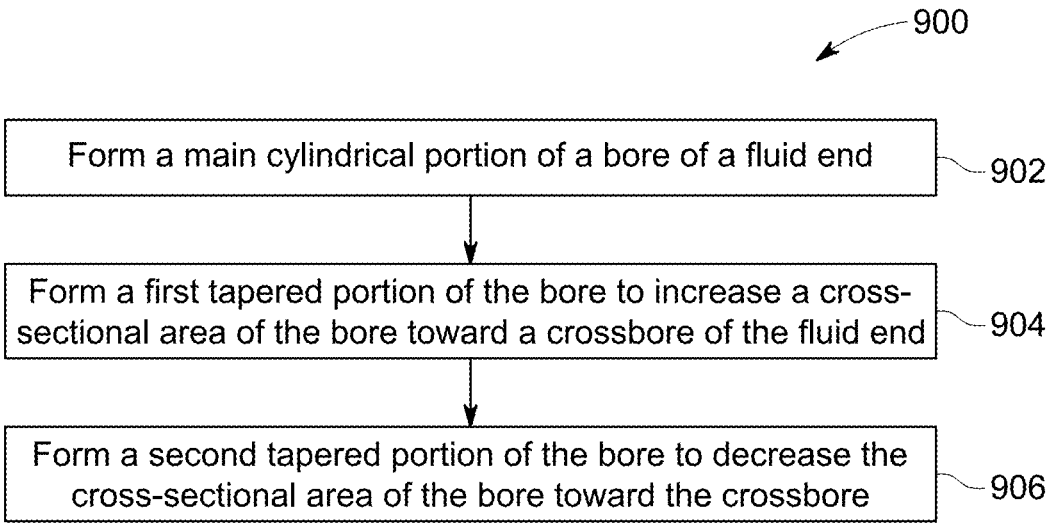
FIG. 12 illustrates a method of manufacturing a fluid end having a crossbore geometry presented herein, according to an example embodiment.

FIG. 12 is a flowchart of a method 900 for manufacturing a fluid end, such as any of the fluid ends 500, 600, 700, 750, 852 discussed herein. It should be noted that the method 900 can be performed differently than depicted. For example, an additional operation can be performed, and/or any of the depicted operations can be performed differently, performed in a different order, and/or not performed. In some embodiments, the method 900 can be performed via a machined process without having to utilize hand-finishing or other manual processes.

At block 902, a main cylindrical portion of a bore (e.g., a horizontal bore) is formed in the fluid end. For instance, material is removed from the bore to form the main cylindrical portion, along which a cross-sectional area of the bore remains substantially the same. The bore extends to intersect with one or more other bores of the fluid end at a crossbore of the fluid end. The main cylindrical portion extends to the crossbore.

At block 904, a first tapered portion of the bore is formed to increase a cross-sectional area of the bore toward the crossbore. For example, a tool with a blade may be inserted into the main cylindrical portion of the bore and moved toward the crossbore, and the blade may be revolved around a center axis extending through the bore to contact the blade with walls of the bore, thereby removing material and adjusting a profile of the main cylindrical portion as the tool is moved toward the crossbore. Revolutions of the blade about the center axis increase in size as the blade is moved toward the crossbore, thereby increasing the cross-sectional area of the bore along the first tapered portion toward the crossbore. The first tapered portion of the bore smooths a transition of the bore to the crossbore, thereby reducing stress concentrations at where the bores intersect with one another (e.g., to form a blended corner of intersection).

At block 906, a second tapered portion of the bore is formed to reduce the cross-sectional area of the bore toward the crossbore. By way of example, the tool with the blade may be moved from the first tapered portion toward the crossbore, and the revolutions of the blade about the center axis may decrease in size as the blade is moved toward the crossbore, thereby decreasing the cross-sectional area of the bore along the second tapered portion toward the crossbore. The second tapered portion of the bore forms a peak with an intersecting bore to provide a ledge with an increased arc length. Consequently, a sufficiently large surface area for engagement with a valve retainer is also provided.

After the geometry of the bore of the fluid end has been formed, a valve retainer may be installed in the fluid end. For instance, the valve retainer may be placed in engagement with the ledge, such as with the peaks, formed via the method 900. The increased arc length of the ledge formed via the second tapered portion of the bore may increase securement of the valve retainer in the fluid end, such as to block or prevent rotation of the valve retainer.

Although the embodiments disclosed herein primarily discuss bores having two tapered portions to form an M-shaped configuration, in additional or alternative embodiments, a bore can have a different quantity of tapered portions to form a differently shaped configuration. As an example, a bore may have more than two tapered portions, such as multiple tapered portions that increase a cross-sectional area of the bore toward a crossbore and/or multiple tapered portions that decrease a cross-sectional area of the bore toward the crossbore. As another example, a bore may have a single tapered portion, such as a tapered portion that decreases the cross-sectional area of the bore (e.g., to provide peaks and form a ledge with an increased arc length) without a tapered portion that increases the cross-sectional area of the bore. Such embodiments of the bore can still provide at least some of the benefits described herein.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Indeed, the techniques described herein can apply to any fluid end block that has at least two intersecting bores. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A fluid end, comprising:

a first bore extending through the fluid end, the first bore including a first main cylindrical portion and a tapered portion;

a second bore extending through the fluid end, the second bore including a second main cylindrical portion;

a third bore including an additional tapered portion; and a crossbore at which the first bore intersects the second bore, wherein the second main cylindrical portion of the second bore terminates at the crossbore to form a ledge in the crossbore, the tapered portion of the first bore and the second main cylindrical portion of the second bore cooperatively define a peak extending inwardly to the crossbore, and the additional tapered portion of the third bore and the second main cylindrical portion of the second bore cooperatively define an additional peak extending inwardly to the crossbore such that the peak, the second main cylindrical portion, and the additional peak cooperatively form an M-shaped configuration.

2. The fluid end of claim 1, further comprising a valve retainer configured to be disposed in the crossbore and engaged with the ledge formed by the second main cylindrical portion of the second bore.

3. The fluid end of claim 2, wherein the valve retainer is further configured to engage the peak cooperatively defined by the tapered portion of the first bore and the second main cylindrical portion of the second bore.

4. The fluid end of claim 1, wherein the first bore comprises a further tapered portion extending between the first main cylindrical portion and the tapered portion, and the further tapered portion increases a cross-sectional area of the first bore along the further tapered portion toward the crossbore.

5. The fluid end of claim 4, wherein the further tapered portion of the first bore extends linearly or arcuately.

6. The fluid end of claim 4, wherein each of the tapered portion and the further tapered portion of the first bore extends arcuately, and a first radius of the additional tapered portion is greater than a second radius of the tapered portion.

7. The fluid end of claim 1, wherein the peak cooperatively defined by the tapered portion of the first bore and the second main cylindrical portion of the second bore is a part of the ledge in the crossbore.

8. A method for manufacturing a fluid end, the method comprising:

forming a first bore of the fluid end, wherein the first bore comprises a main cylindrical portion;

forming a second bore of the fluid end to intersect with the first bore at a crossbore of the fluid end, wherein forming the second bore comprises forming a tapered portion of the second bore, the tapered portion reducing a cross-sectional area of the second bore along the tapered portion toward the crossbore, and the tapered portion and the main cylindrical portion cooperatively define a peak that extends inwardly to the crossbore; and forming a third bore of the fluid end, wherein forming the third bore comprises forming an additional tapered portion of the third bore, and the additional tapered portion of the third bore and the main cylindrical portion of the first bore cooperatively define an additional peak extending inwardly to the crossbore such that the peak, the main cylindrical portion, and the additional peak cooperatively form an M-shaped configuration.

9. The method of claim 8, wherein forming the second bore comprises forming a further tapered portion of the second bore, and the further tapered portion increases the cross-sectional area of the second bore along the further tapered portion toward the tapered portion and the crossbore of the fluid end.

10. The method of claim 9, wherein forming the second bore comprises forming an additional main cylindrical portion extending toward the tapered portion of the second bore.

11. The method of claim 8, wherein forming the tapered portion of the second bore comprises moving a tool with a blade between the second bore and the crossbore along a center axis of the second bore and revolving the tool about the center axis to remove material from the second bore.

12. The method of claim 11, wherein moving the tool with the blade between the second bore and the crossbore along the center axis comprises moving the tool with the blade from the second bore toward the crossbore.

13. The method of claim 8, wherein the main cylindrical portion of the first bore terminates at the crossbore to provide a ledge defining a groove, and the method further comprises disposing a valve retainer in the groove to engage the valve retainer with the peak cooperatively defined by the tapered portion and the main cylindrical portion.

14. A fluid end, comprising:

a first bore comprising a cylindrical portion; and a second bore extending through the fluid end and intersecting the first bore at a crossbore, wherein the second bore comprises a first tapered portion increasing a cross-sectional area of the second bore along the first tapered portion toward the crossbore, the second bore comprises a second tapered portion reducing the cross-sectional area of the second bore along the second tapered portion toward the crossbore, and the second tapered portion interfaces with the cylindrical portion of the first bore.

15. The fluid end of claim 14, wherein the second tapered portion of the second bore interfaces with the cylindrical portion of the first bore to form a peak extending inwardly to the crossbore.

16. The fluid end of claim 15, further comprising:

a groove at least partially formed by the cylindrical portion of the first bore and the peak formed by the interface between the second tapered portion of the second bore and the cylindrical portion of the first bore; and a valve retainer disposed in the groove.

17. The fluid end of claim 15, wherein the second bore comprises an additional cylindrical portion extending along an axis, and the peak extends transverse to the axis.

18. The fluid end of claim 17, wherein the peak extends inwardly beyond the additional cylindrical portion.

19. The fluid end of claim 14, wherein the second tapered portion extends arcuately.

20. A method for manufacturing a fluid end, the method comprising:

forming a first bore of the fluid end, wherein the first bore comprises a main cylindrical portion; and forming a second bore of the fluid end to intersect with the first bore at a crossbore of the fluid end, wherein forming the second bore comprises forming a tapered portion and an additional tapered portion of the second bore, the tapered portion reducing a cross-sectional area of the second bore along the tapered portion toward the crossbore, the tapered portion and the main cylindrical portion cooperatively define a peak that extends inwardly to the crossbore, and the additional tapered portion increases the cross-sectional area of the second bore along the additional tapered portion toward the tapered portion and the crossbore of the fluid end.

* * * * *